US007796903B2

(12) United States Patent
Kagawa et al.

(10) Patent No.: US 7,796,903 B2
(45) Date of Patent: Sep. 14, 2010

(54) CHARGING APPARATUS WITH A DISCHARGE ELECTRODE HAVING A PLURALITY OF SHARP-POINTED PORTIONS

(75) Inventors: Toshiaki Kagawa, Nara (JP); Hiroshi Doshohda, Chiba (JP); Katsumi Adachi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 46 days.

(21) Appl. No.: 12/163,056

(22) Filed: Jun. 27, 2008

(65) Prior Publication Data

US 2009/0003859 A1 Jan. 1, 2009

(30) Foreign Application Priority Data

Jun. 28, 2007 (JP) ..... 2007-171161

(51) Int. Cl.
*G03G 15/02* (2006.01)
*B41J 2/415* (2006.01)

(52) U.S. Cl. ..... 399/50; 347/127

(58) Field of Classification Search ..... 399/50, 399/174, 89, 115, 168, 296; 347/128, 127
See application file for complete search history.

(56) References Cited

U.S. PATENT DOCUMENTS 4,558,334 A * 12/1985 Fotland ..... 347/128
4,700,261 A * 10/1987 Nagase et al. ..... 361/225
4,783,716 A 11/1988 Nagase et al.
5,367,366 A 11/1994 Kido et al.
5,983,060 A 11/1999 Namekata et al.
2006/0280524 A1 * 12/2006 Hays et al. ..... 399/168

FOREIGN PATENT DOCUMENTS

| | | |
|---|---|---|
| JP | 61-036782 | 2/1986 |
| JP | 62-141570 | 6/1987 |
| JP | 63-136061 | 6/1988 |
| JP | 63216075 A * | 9/1988 |
| JP | 06-011946 | 1/1994 |
| JP | 08-160711 | 6/1996 |
| JP | 10-104963 | 4/1998 |

(Continued)

OTHER PUBLICATIONS

Machine English translation of Ikeda et al. (JP2003-249327).*

(Continued)

*Primary Examiner*—David M Gray
*Assistant Examiner*—Billy J Lactaoen
(74) *Attorney, Agent, or Firm*—David G. Conlin; Steven M. Jensen; Edwards Angell Palmer & Dodge LLP

(57) ABSTRACT

A charging apparatus which is excellent in charging uniformity and thus allows a to-be-charged body to be charged uniformly and in which the generation of discharge products can be reduced, is provided. In the charging apparatus, ions are generated under the difference in electrical potential between the discharge electrode and the induction electrode produced in the ion generating section. The generated ions are caused to flow toward the counter electrode, whereupon the to-be-charged body arranged between the ion generating section and the counter electrode is charged.

23 Claims, 11 Drawing Sheets

FOREIGN PATENT DOCUMENTS

| | | |
|---|---|---|
| JP | 10-274892 | 10/1998 |
| JP | 11-194581 | 7/1999 |
| JP | 2001-083779 | 3/2001 |
| JP | 2002-237368 | 8/2002 |
| JP | 2003-249327 | 9/2003 |
| JP | 2004-069860 | 3/2004 |
| JP | 2004-157447 | 6/2004 |
| JP | 2007-012489 | 1/2007 |

OTHER PUBLICATIONS

Machine English translation of Saikawa et al. (JP2001-083779).*
Machine English translation of Matsuzoe (JP2002-237368).*
Partial English translation of Ootake et al. (JP63-216075).*

* cited by examiner

CHARGING APPARATUS WITH A DISCHARGE ELECTRODE HAVING A PLURALITY OF SHARP-POINTED PORTIONS

CROSS-REFERENCE TO RELATED APPLICATION

This application claims priority to Japanese Patent Application No. 2007-171161, which was filed on Jun. 28, 2007, the contents of which are incorporated herein by reference in its entirety.

BACKGROUND OF THE INVENTION

1. Field of the Invention

The present invention relates to a charging apparatus and an image forming apparatus having the charging apparatus.

2. Description of the Related Art

In an image forming apparatus which employs an electrophotographic method, a charging apparatus of a corona discharge type is used for its charging section which uniformly charges a photoreceptor, namely an image bearing member which bears an electrostatic latent image thereon, transfer section which transfers a toner image formed on the photoreceptor onto a recording sheet, which is a material subjected to transfer and a recording medium as well, via a transfer belt which is a member subjected to transfer and an intermediate transfer member as well, separating section which strips the recording sheet kept in electrostatic contact with the photoreceptor, and so forth. Such a corona discharge-type charging apparatus is disclosed in Japanese Unexamined Patent Publication JP-A 6-11946 (1994). The charging apparatus disclosed in JP-A 6-11946 is composed of a shield case having an opening formed face to face with a to-be-charged body such as a photoreceptor and a transfer belt, and a discharge electrode installed inside the shield case in a stretched manner, the discharge surface of which has a linear shape, a serrated shape, or an acicular shape. The charging apparatus disclosed in JP-A 6-11946 is built as a so-called corotron charger and a so-called scorotron charger as well. In the corotron charger, a high voltage is applied to the discharge electrode to cause corona discharger so that the to-be-charged body can be uniformly charged. In the scorotron charger, a grid electrode is disposed between the discharge electrode and the to-be-charged body, and a voltage of a desired level is applied to the grid electrode so as for the to-be-charged body to be uniformly charged.

FIG. 10 is a view for explaining a charging mechanism associated with a corona discharge-type charging apparatus. Through the application of a high voltage to a region between a discharge electrode 71 having a small radius of curvature and a grid electrode 72, a non-uniform electric field is generated between the two electrodes. In consequence, a local ionization effect is produced in the vicinity of the discharge electrode 71 by an intense electric field, whereupon electrons are discharged in a direction D facing a to-be-charged body 11 (a discharge phenomenon induced by an avalanche of electrons). In this way, the to-be-charged body 11 is discharged. Note that the grid electrode 72 is disposed to control the quantity of electrons that travel toward the to-be-charged body 11. The grid electrode 72 is also subjected to electron discharge.

Moreover, the corona discharge-type charging apparatus described just above is also utilized as a before-transfer charging apparatus in which a toner image formed on the to-be-charged body 11 is charged before being transferred onto a material subjected to transfer. Such a corona discharge-type before-transfer charging apparatus is disclosed in Japanese Unexamined Patent Publications JP-A 10-274892 (1998) and JP-A 2004-69860, for example. According to the before-transfer charging apparatuses disclosed in JP-A 10-274892 and JP-A 2004-69860, in a case where a toner image formed on the to-be-charged body 11 exhibits variation in charging amount, the amount of charge on the toner image is made uniform before the toner image is transferred onto the material subjected to transfer. This makes it possible to suppress a decline in transfer margin at the time of transferring the toner image onto the material subjected to transfer, and thereby transfer the toner image onto the material subjected to transfer with stability.

However, the corona discharge-type charging apparatuses disclosed in JP-A 6-11946, JP-A 10-274892, and JP-A 2004-69860 described supra present a plurality of problems. The first problem resides in a space for placing the charging apparatus. The corona discharge-type charging apparatus necessitates not only the discharge electrode 71 but also the shield case, the grid electrode 72, and so forth. Furthermore, there is a need to secure a relatively large spacing between the discharge electrode 71 and the to-be-charged body 11 (approximately 10 mm, for instance). It will thus be necessary to provide a wider space to place the charging apparatus. In an image forming apparatus, in the vicinity of the charging apparatus are arranged a photoreceptor, a developing section which forms a toner image on the photoreceptor by supplying toner to an electrostatic latent image formed on the photoreceptor, a primary transfer section which transfers the toner image formed on the photoreceptor onto a transfer belt, a secondary transfer section which transfers the toner image formed on the transfer belt onto a recording sheet, and so forth. For that, there is not sufficient space for the placement of the charging apparatus. This makes difficult the layout of the corona discharge-type charging apparatus which occupies a relatively large space.

The second problem resides in a discharge product which is formed when the to-be-charged body 11 is charged by the charging apparatus. In the corona discharge-type charging apparatus, as shown in FIG. 10, discharge products such as ozone ($O_3$) and oxides of nitrogen (NOx) are produced in large quantity. To be specific, with the energy released in accompaniment with the discharge of electrons from the charging apparatus, molecular nitrogen ($N_2$) present in the air is dissociated into nitrogen atom (N), and the nitrogen atom is combined with molecular oxygen ($O_2$) to form oxides of nitrogen (nitrogen dioxide: $NO_2$). Similarly, molecular oxygen ($O_2$) present in the air is dissociated into oxygen atom (O), and the oxygen atom is combined with molecular oxygen ($O_2$) to form ozone ($O_3$). If ozone is produced in large quantity in that way, various problems will arise such as occurrence of ozone odor, detrimental effects on the human body, and quality degradation in components induced by significant oxidative power. On the other hand, if oxides of nitrogen are produced, a defective image will be caused, because the oxides of nitrogen are adhered to the photoreceptor as ammonium salt (ammonium nitrate). In particular, in a case where an organic photoreceptor (OPC) is used as the photoreceptor, image imperfection such as a white patch or friar and image deletion caused by ozone and nitrogen oxides tends to occur.

The third problem resides in a corona wind which is generated when the to-be-charged body 11 is charged by the charging apparatus. The corona wind is generated in a direction from the discharge electrode 71 to the to-be-charged body 11 with the flow of electrons released by corona discharge. In the case of using the corona discharge-type charging apparatus as a before-transfer charging apparatus, a toner image formed on the to-be-charged body 11 will be distorted due to the corona wind.

As a charging apparatus which is capable of reducing discharge product generation, there has been proposed a charging apparatus of a contact charging type in which charging is effected by bringing a conductive roller or a conductive brush into contact with a to-be-charged body. In this contact charging-type charging apparatus, however, since the to-be-charged body is charged through the contact with the conductive roller or conductive brush, it is difficult to achieve the charging without distorting a toner image formed on the to-be-charged body. Therefore, the use of the contact charging-type charging apparatus as a before-transfer charging apparatus will be inappropriate.

Moreover, in Japanese Unexamined Patent Publication JP-A 8-160711 (1996) is disclosed a corona discharge-type charging apparatus which is capable of reducing discharge product generation. The charging apparatus disclosed in JP-A 8-160711 is composed of: a plurality of discharge electrodes arranged at a substantially uniform pitch in a predetermined axial direction; a high-voltage power supply which applies, to the discharge electrode, a voltage which is greater than or equal to a predetermined discharge inception voltage; a resistor element placed between an output electrode of the high-voltage power supply and the discharge electrode; a grid electrode placed at a position between the discharge electrode and a to-be-charged body in the proximity of the discharge electrode; and a grid power supply which applies a predetermined grid voltage to the grid electrode. The gap between the discharge electrode and the grid electrode is set at or below 4 mm. In this way, by adjusting the gap between the discharge electrode and the grid electrode to be small, it is possible to decrease discharge current and thereby reduce discharge product generation.

However, in the charging apparatus disclosed in JP-A 8-160711, ozone of approximately 0.3 ppm is evolved. That is, the effect of reducing discharge product generation is not good enough. Furthermore, in the charging apparatus disclosed in JP-A 8-160711, the gap between the discharge electrode and the grid electrode is so small that discharge products, as well as foreign matters such as toner and powdery paper originating from a recording sheet which is a material subjected to transfer, are prone to adhere to the discharge electrode. The removal (cleaning) of such a foreign matter adhered to the discharge electrode is difficult to achieve, because the discharge surface of the discharge electrode in the corona discharge system is given a complicated configuration, such as an acicular shape. In addition, the front end of the discharge electrode is susceptible to abrasion and quality degradation due to discharge energy, which results in lack of stability in the discharging effected by the discharge electrode. Furthermore, in the charging apparatus disclosed in JP-A 8-160711, since the to-be-charged body is arranged in a short distance away from the discharge electrode, it is likely that variation in charging will arise in a lengthwise direction due to the pitch of arrangement of a plurality of discharge electrodes (the axial direction in which are arranged a plurality of discharge electrodes). Although it may be possible to reduce the pitch of arrangement of the discharge electrodes to eliminate the charging variation, the reduction of pitch leads to an increased number of discharge electrodes and thus to increased manufacturing costs.

In Japanese Unexamined Patent Publication JP-A 2003-249327 is disclosed a charging apparatus of a creeping discharge type. In the creeping discharge-type charging apparatus, an induction electrode and a discharge electrode having a peaked plate-shaped outer periphery are arranged face to face with each other, with a dielectric body lying therebetween. A to-be-charged body is placed opposite from the induction electrode so as to face the discharge electrode. In the creeping discharge-type charging apparatus, a pulse waveform voltage is applied between the two electrodes thereby to cause emission of ions. The to-be-charged body is charged by the resultant ions.

The creeping discharge-type charging apparatus does not necessitate a shield case, a grid electrode, and so forth that are provided in the corona discharge-type charging apparatus. Therefore, a space for placing the charging apparatus can be made relatively small. Moreover, in the creeping discharge-type charging apparatus, the discharge electrode is formed in the shape of a plate, and its discharge surface is made flat. Accordingly, even if a foreign matter is adhered to the discharge electrode, the foreign matter can be cleaned off with ease. Further, in the creeping discharge-type charging apparatus, no corona wind is generated. This is because discharging is effected between the discharge electrode and the induction electrode. It thus never occurs that a toner image formed on the to-be-charged body is distorted by the corona wind.

In the creeping discharge-type charging apparatus disclosed in JP-A 2003-249327, however, the ions generated through the application of a pulse waveform voltage between the discharge electrode and the induction electrode remain in the vicinity of the discharge electrode without traveling vigorously toward the to-be-charged body. In this case, there arises variation in the flow of ions during the interval when the ions remaining in the discharge electrode are being moved to the to-be-charged body. This makes it difficult for the to-be-charged body to be charged uniformly. Furthermore, since the ions generated through the application of a pulse waveform voltage remain in the vicinity of the discharge electrode, it follows that, with respect to the quantity of ions generated, the ions which can be utilized to effect charging on the to-be-charged body are few in quantity. This leads to poor ion-use efficiency. In order to increase the quantity of ions which travel toward the to-be-charged body, there is a need to increase the applied voltage or frequency of the pulse waveform voltage. However, the increase of the applied voltage or frequency requires a measurable amount of electric power and also causes a decrease in the service lifespan of the discharge electrode. In addition to that, the generation amount of discharge products such as ozone will be increased.

SUMMARY OF THE INVENTION

Accordingly, it is an object of the invention to provide a charging apparatus which is excellent in charging uniformity and thus allows a to-be-charged body to be charged uniformly and in which the generation of discharge products can be reduced, and an image forming apparatus provided with the charging apparatus.

The invention provides a charging apparatus for charging an image bearing member which bears thereon an electrostatic latent image that is provided in an image forming apparatus, comprising:

an ion generating section which generates ions to charge a toner image formed on the image bearing member; and a counter electrode arranged face to face with the ion generating section, which controls a flow of ions generated by the ion generating section, the ion generating section including a discharge electrode formed on a surface of a dielectric body, an induction electrode formed on a back surface or in an inside of the dielectric body so as to be arranged face to face with the discharge electrode via the dielectric body lying therebetween, and a discharge voltage applying section which applies a voltage between the discharge electrode and the induction electrode, and the ion generating section generating ions by producing a difference of electrical potential between the discharge electrode and the induction electrode by the discharge voltage applying section, and charging the toner image on the image bearing member arranged between the ion generating section and the counter electrode by flowing the generated ions toward the counter electrode.

According to the invention, the ions generated under the difference in electrical potential between the discharge electrode and the induction electrode produced in the ion generating section are caused to flow toward the counter electrode, whereupon the image bearing member arranged between the ion generating section and the counter electrode is charged. In this case, it is possible to prevent occurrence of variation in the flow of ions flowing toward the image bearing member, and thereby charge the image bearing member uniformly. Moreover, since the toner image formed on the image bearing member is charged by causing the ions generated by the ion generating section to flow toward the counter electrode, it is possible to prevent ions from remaining in the vicinity of the discharge electrode. Accordingly, it never occurs that, with respect to the quantity of the ions generated by the ion generating section, the ones that can be utilized to charge the toner image formed on the image bearing member are few in quantity. This leads to enhanced ion-use efficiency. That is, the Con generating section is capable of generating ions in an amount required for charging the toner image formed on the image bearing member properly even under the condition that an applied voltage to be applied to the discharge electrode is relatively small. As a result, the generation amount of discharge products such as ozone can be reduced.

Further, the invention provides a charging apparatus for charging an intermediate transfer member on which is formed a transferred toner image by transferring a toner image which is formed on an image bearing member provided in an image forming apparatus by supplying toner to an electrostatic latent image formed on the image bearing member, comprising:

an ion generating section which generates ions to charge the toner image transferred on the intermediate transfer member; and a counter electrode arranged face to face with the ion generating section, which controls a flow of ions generated by the ion generating section, the ion generating section including a discharge electrode formed on a surface of a dielectric body, an induction electrode formed on a back surface or in an inside of the dielectric body so as to be arranged face to face with the discharge electrode, via the dielectric body lying therebetween, and a discharge voltage applying section which applies a voltage between the discharge electrode and the induction electrode, and the ion generating section generating ions by producing a difference of electrical potential between the discharge electrode and the induction electrode by the discharge voltage applying section, and charging the toner image on the intermediate transfer member arranged between the ion generating section and the counter electrode by flowing the generated ions toward the counter electrode.

According to the invention, the ions generated under the difference in electrical potential between the discharge electrode and the induction electrode produced in the ion generating section are caused to flow toward the counter electrode, whereupon the toner image transferred on the intermediate transfer member arranged between the ion generating section and the counter electrode is charged. In this case, it is possible to prevent occurrence of variation in the flow of ions flowing toward the toner image transferred on the intermediate transfer member, and thereby charge the toner image transferred on the intermediate transfer member uniformly. Moreover, since the toner image transferred on the intermediate transfer member is charged by causing the ions generated by the ion generating section to flow toward the counter electrode, it is possible to prevent ions from remaining in the vicinity of the discharge electrode. Accordingly, it never occurs that, with respect to the quantity of the ions generated by the ion generating section, the ones that can be utilized to charge the toner image transferred on the intermediate transfer member are few in quantity. This leads to enhanced ion-use efficiency. That is, the ion generating section is capable of generating ions in an amount required for charging the toner image transferred on the intermediate transfer member properly even under the condition that an applied voltage to be applied to the discharge electrode is relatively small. As a result, the generation amount of discharge products such as ozone can be reduced. Further, since discharging takes place between the discharge electrode and the induction electrode, it is possible to prevent generation of a corona wind that is associated with a conventional corona discharge-type charging apparatus. Therefore, it never occurs that the toner image transferred on the intermediate transfer member is charged in a distorted state.

Further, in the invention, it is preferable that the image bearing member is charged while being moved between the ion generating section and the counter electrode, and the discharge electrode is so formed as to extend in a direction perpendicular to a direction in which the image bearing member is moved, to have a shape which is conformable to the surface of the image bearing member, and to have an edge with a plurality of sharp-pointed portions so as to take on serrations.

According to the invention, the image bearing member is charged while being moved between the ion generating section and the counter electrode. The discharge electrode is so formed as to extend in a direction perpendicular to the direction in which the image bearing member is moved, to have a shape which is conformable to the surface of the image bearing member, and to have an edge with a plurality of sharp-pointed portions so as to take on serrations. When ions are generated under the difference in electrical potential between the discharge electrode and the induction electrode produced in the ion generating section, the convergence of electric field takes place between the sharp-pointed portions of the discharge electrode and the induction electrode, in consequence whereof discharging tends to occur between the discharge electrode and the induction electrode. Therefore, the ion generating section is capable of generating ions in an amount required for charging the image bearing member properly even under the condition that an applied voltage to be applied to the discharge electrode is relatively small. This makes it possible to reduce electric power consumption, as well as to prolong the service lifespan of the discharge electrode. In addition to that, the generation amount of discharge products such as ozone can be reduced.

Further, in the invention, it is preferable that the intermediate transfer member is charged while being moved between the ion generating section and the counter electrode, and the discharge electrode is so formed as to extend in a direction perpendicular to a direction in which the intermediate transfer member is moved, to have a shape which is conformable to the surface of the intermediate transfer member, and to have an edge with a plurality of sharp-pointed portions so as to take on serrations.

According to the invention, the intermediate transfer member is charged while being moved between the ion generating section and the counter electrode. The discharge electrode is so formed as to extend in a direction perpendicular to the direction in which the intermediate transfer member is moved, to have a shape which is conformable to the surface of the intermediate transfer member, and to have an edge with a plurality of sharp-pointed portions so as to take on serrations. When ions are generated under the difference in electrical potential between the discharge electrode and the induction electrode produced in the ion generating section, the convergence of electric field takes place between the sharp-pointed portions of the discharge electrode and the induction electrode, in consequence whereof discharging tends to occur between the discharge electrode and the induction electrode. Therefore, the ion generating section is capable of generating ions in an amount required for charging the intermediate transfer member properly even under the condition that an applied voltage to be applied to the discharge electrode is relatively small. This makes it possible to reduce electric power consumption, as well as to prolong the service lifespan of the discharge electrode. In addition to that, the generation amount of discharge products such as ozone can be reduced.

Further, in the invention, it is preferable that the induction electrode is so formed as to lie only at a location facing with the sharp-pointed portions.

According to the invention, the induction electrode is so formed as to lie only at a location facing with the sharp-pointed portions of the discharge electrode. In this case, in contrast to the case of forming the induction electrode so as to lie at a location facing with the discharge electrode in its entirety, it is possible to reduce the area of discharging. Accordingly, at the time of producing ions in an amount required for charging the image bearing member or the intermediate transfer member, the generation amount of discharge products such as ozone can be reduced.

Further, in the invention, it is preferable that a relationship: $p/g \leqq 1$ is satisfied, wherein p (mm) is a pointedness pitch that is an interval between the tips of two sharp-pointed portions, and g (mm) is a distance from the discharge electrode to the image bearing member or the intermediate transfer member.

According to the invention, given the interval between the tips of two sharp-pointed portions, namely the pointedness pitch, of p (mm) and given the distance from the discharge electrode to the image bearing member or the intermediate transfer member of g (mm), then the relationship: $p/g \leqq 1$ is satisfied. In this case, the pointedness pitch can be adjusted to be relatively small or the distance from the discharge electrode to the image bearing member or the intermediate transfer member can be adjusted to be relatively large. This makes it possible to prevent the image bearing member or the intermediate transfer member from being charged in the presence of variation in charging ascribed to the pointedness pitch, and thereby allow the image bearing member or the intermediate transfer member to be charged uniformly.

Further, in the invention, it is preferable that a relationship: $p/g \geqq 0.06$ is satisfied, wherein p (mm) is a pointedness pitch that is an interval between the tips of two sharp-pointed portions, and g (mm) is a distance from the discharge electrode to the image bearing member or the intermediate transfer member.

According to the invention, given the pointedness pitch in the discharge electrode of p (mm) and given the distance from the discharge electrode to the image bearing member or the intermediate transfer member of g (mm), then the relationship: $p/g \geqq 0.06$ is satisfied. In this case, the area of discharging can be adjusted to be small with an increased pointedness pitch or an applied voltage to be applied to the discharge electrode can be adjusted to be small with a decreased distance from the discharge electrode to the image bearing member or the intermediate transfer member. In this state, ions can be produced in an amount required for charging the image bearing member or the intermediate transfer member properly. Therefore, the generation amount of discharge products such as ozone can be reduced.

Further, in the invention, it is preferable that a plurality of ion generating sections are arranged side by side along a direction in which the image bearing member or the intermediate transfer member is moved.

According to the invention, a plurality of ion generating sections are arranged side by side along the direction in which the image bearing member or the intermediate transfer member is moved. In this case, ions can be produced in an amount required for charging the image bearing member or the intermediate transfer member under the condition that the electric current density per discharge electrode is low. Therefore, the service lifespan of each of the discharge electrodes can be prolonged.

Further, in the invention, it is preferable that a protective layer which maintains insulation between the discharge electrode and the induction electrode is formed on the dielectric body so as to cover the discharge electrode.

According to the invention, the protective layer which maintains insulation between the discharge electrode and the induction electrode is formed on the dielectric body so as to cover the discharge electrode. This makes it possible to prevent an electric current passing through the discharge electrode in a voltage-applied state from flowing into the induction electrode via the dielectric body, and thereby maintain the insulation between the discharge electrode and the induction electrode. Moreover, since the protective layer is so formed as to cover the discharge electrode, it is possible to protect the discharge electrode against abrasion and quality degradation that are caused by discharge energy released upon the application of a voltage to the discharge electrode.

Further, in the invention, it is preferable that the dielectric body is made of a ceramics.

According to the invention, the dielectric body is made of a ceramics and is thus prevented from absorbing moisture. It is therefore possible to prevent occurrence of a decline in discharging capability caused by the moisture absorptive action of the dielectric body, and thereby generate ions for charging the image bearing member or the intermediate transfer member with stability even under high-humidity environment.

Further, in the invention, it is preferable that the charging apparatus comprises a heating section which applies heat to the dielectric body.

According to the invention, there is provided the heating section which applies heat to the dielectric body. In this case, the moisture absorptive action of the dielectric body under high-humidity environment can be prevented more reliably. It is therefore possible to prevent occurrence of a decline in discharging capability caused by the moisture absorptive action of the dielectric body, and thereby generate ions for charging the image bearing member or the intermediate transfer member with stability even under high-humidity environment.

Further, in the invention, it is preferable that the induction electrode serves also as the heating section.

According to the invention, the induction electrode serves also as the heating section which heats the dielectric body. In this case, there is no need to provide an additional heating section which prevents the dielectric body from absorbing moisture. This makes it possible to avoid an undesirable increase in equipment size and cost.

Further, in the invention, it is preferable that the counter electrode is grounded.

According to the invention, the counter electrode is grounded. In this case, an electric field is produced between the discharge electrode and the counter electrode, thus causing the ions generated in the vicinity of the discharge electrode to flow toward the counter electrode efficiently. This leads to enhanced ion-use efficiency. It is therefore possible to produce ions in an amount required for charging the image bearing member or the intermediate transfer member properly even under the condition that an applied voltage to be applied to the discharge electrode is relatively small. As a result, electric power consumption can be reduced and the service lifespan of the discharge electrode can be prolonged. In addition to that, the generation amount of discharge products such as ozone can be reduced.

Further, in the invention, it is preferable that the charging apparatus comprises a counter voltage applying section which applies to the counter electrode, a voltage of a polarity reverse to the polarity of a voltage which is applied to the discharge electrode by the discharge voltage applying section.

According to the invention, at the time of producing ions in an amount required for charging the image bearing member or the intermediate transfer member, the counter voltage applying section applies, to the opposite electrode, a voltage of a polarity reverse to the polarity of a voltage to be applied to the discharge electrode. Therefore, the ions generated in the vicinity of the discharge electrode are caused to flow toward the counter electrode more efficiently.

Further, in the invention, it is preferable that the discharge voltage applying section acts to apply a voltage of a magnitude which is greater than or equal to the magnitude of a voltage at which the amount of charge on the image bearing member or the intermediate transfer member is brought to a saturating amount.

Further, in the invention, it is preferable that the counter voltage applying section acts to apply a voltage of a magnitude which is greater than or equal to the magnitude of a voltage at which the amount of charge on the image bearing member or the intermediate transfer member is brought to a saturating amount.

According to the invention, the discharge voltage applying section which applies a voltage to the discharge electrode or the counter voltage applying section which applies a voltage to the counter electrode acts to apply a voltage of a magnitude which is greater than or equal to the magnitude of a voltage at which the amount of charge on the image bearing member or the intermediate transfer member is brought to a saturating amount. That is, at the time of producing ions in an amount required for charging the image bearing member or the intermediate transfer member, the discharge electrode or the counter electrode receives application of a voltage of a magnitude large enough for the amount of charge on the image bearing member or the intermediate transfer member to reach a saturating amount. Accordingly, even if there is some variation in the generation amount of ions, the image bearing member or the intermediate transfer member can be charged uniformly.

Further, in the invention, it is preferable that the charging apparatus comprises a voltage control section which controls a magnitude of a voltage which is applied by the discharge voltage applying section on the basis of an amount of electric current flowing through the counter electrode.

Further, in the invention, it is preferable that the charging apparatus comprises a voltage control section which controls a magnitude of a voltage which is applied by the counter voltage applying section on the basis of an amount of electric current flowing through the counter electrode.

According to the invention, the voltage control section controls a magnitude of a voltage which is applied to the discharge electrode or the counter electrode on the basis of an amount of electric current flowing through the counter electrode. The generation amount of ions changes with the adhesion of foreign matters to the discharge electrode and also changes according to environmental conditions under which ions are generated, etc. Moreover, for example, due to the change of wind flow in the vicinity of the discharge electrode and so forth, the rate at which the generated ions reach the image bearing member or the intermediate transfer member is caused to vary. In this case, even if a voltage to be applied to the discharge electrode is kept constant, there may be a case where the amount of charge on the image bearing member or the intermediate transfer member does not remain the same. Therefore, in light of the fact that there is a correlation between the amount of charge on the image bearing member or the intermediate transfer member and the amount of electric current passing through the counter electrode, the amount of electric current passing through the counter electrode is defined as an indication to control the amount of charge on the image bearing member or the intermediate transfer member. On the basis of this indication, the magnitude of a voltage to be applied to the discharge electrode is controlled. This makes it possible to impart optimal ion quantity to the image bearing member or the intermediate transfer member at all times.

Further, in the invention, it is preferable that the voltage control section exercises feedback control over a magnitude of a voltage which is applied by the discharge voltage applying section so that the amount of electric current passing through the counter electrode is greater than or equal to the amount of electric current passing through the counter electrode at the time when the amount of charge on the image bearing member or the intermediate transfer member is brought to a saturating amount.

Further, in the invention, it is preferable that the voltage control section exercises feedback control over a magnitude of a voltage which is applied by the counter voltage applying section so that the amount of electric current passing through the counter electrode is greater than or equal to the amount of electric current passing through the counter electrode at the time when the amount of charge on the image bearing member or the intermediate transfer member is brought to a saturating amount.

According to the invention, the voltage control section exercises feedback control over a magnitude of a voltage which is applied to the discharge electrode or the counter electrode so that the amount of electric current passing through the counter electrode is greater than or equal to the amount of electric current passing through the counter electrode at the time when the amount of charge on the image bearing member or the intermediate transfer member is brought to a saturating amount. Therefore, even if the generation amount of ions changes with the adhesion of foreign matters to the discharge electrode or changes according to environmental conditions under which ions are generated, etc, since the magnitude of a voltage to be applied to the discharge electrode or the counter electrode can be feedback-controlled, it is possible to impart optimal Ion quantity to the image bearing member or the intermediate transfer member at all times.

The invention provides an image forming apparatus comprising:

an image bearing member which bears thereon an electrostatic latent image;

a developing section which forms a toner image by supplying toner to the electrostatic latent image formed on the image bearing member;

a transfer section which transfers the toner image formed on the image bearing member onto a recording medium via an intermediate transfer member;

a fixing section which allows the toner image borne on the recording medium to be fixed in place;

a first charging section which charges the toner image on the image bearing member; and a second charging section which charges the toner image borne on the intermediate transfer member, at least one of the first charging section and the second charging section being constituted by any of the charging apparatuses set forth hereinabove.

According to the invention, when the image bearing member or the intermediate transfer member, etc. is charged by the charging section, the image bearing member or the intermediate transfer member can be uniformly charged under the condition that the generation amount of discharge products such as ozone is reduced. Therefore, the image bearing member or the intermediate transfer member can be protected from the adhesion of discharge products. This makes it possible to prevent occurrence of image imperfection, such as a white patch or friar and image deletion, caused by the adhesion of discharge products to the image bearing member or the intermediate transfer member. Moreover, since generation of highly oxidative ozone can be prevented, it is possible to prevent occurrence of oxidation-induced quality degradation in the components constituting the image forming apparatus.

Further, in the invention, it is preferable that the transfer section includes an intermediate transfer section which transfers a toner image formed on the image bearing member onto the intermediate transfer member and a recording transfer section which transfers the toner image formed on the intermediate transfer member onto a recording medium, and the first charging section effects charging on the toner image formed on the image bearing member before the toner image is transferred onto the intermediate transfer member by the intermediate transfer section.

According to the invention, the first charging section effects charging on the toner image formed on the image bearing member before the toner image is transferred onto the intermediate transfer member by the intermediate transfer section. Accordingly, the toner image can be transferred onto the intermediate transfer member with an increased amount of charge thereon and thus with an enhanced transfer efficiency. Moreover, the charging section effects charging on the toner image while preventing generation of a corona wind. This prevents the toner image from being distorted.

Further, in the invention, it is preferable that the transfer section includes an intermediate transfer section which transfers a toner image formed on the image bearing member onto the intermediate transfer member and a recording transfer section which transfers the toner image formed on the intermediate transfer member onto a recording medium, and that the second charging section effects charging on the toner image which has been transferred on the intermediate transfer member by the intermediate transfer section and is not yet transferred onto the recording medium by the recording transfer section.

According to the invention, the second charging section effects charging on the toner image which has been transferred on the intermediate transfer member by the intermediate transfer section and is not yet transferred onto the recording medium by the recording transfer section. Accordingly, the toner image can be transferred onto the recording medium with an increased amount of charge thereon and thus with an enhanced transfer efficiency. Moreover, the charging section effects charging on the toner image while preventing generation of a corona wind. This prevents the toner image from being distorted.

Further, in the invention, it is preferable that the transfer section includes an intermediate transfer section which transfers a toner image formed on the image bearing member onto the intermediate transfer member and a recording transfer section which transfers the toner image formed on the intermediate transfer member onto a recording medium, and that the charging apparatus comprises a first charging section which charges the toner image formed on the image bearing member before the toner image is transferred onto the intermediate transfer member by the intermediate transfer section and a second charging section which charges the toner image transferredly formed on the intermediate transfer member by the intermediate transfer section before the toner image is transferred onto the recording medium by the recording transfer section.

According to the invention, the charging apparatus comprises a first charging section which charges the toner image formed on the image bearing member before the toner image is transferred onto the intermediate transfer member by the intermediate transfer section and a second charging section which charges the toner image transferredly formed on the intermediate transfer member by the intermediate transfer section before the toner image is transferred onto the recording medium by the recording transfer section. In this construction, at the time of transferring the toner image formed on the image bearing member onto the intermediate transfer members the toner image is charged by the first charging section. Then, at the time of transferring the toner image formed on the intermediate transfer member onto the recording medium, the toner image is charged by the second charging section. Accordingly, it is possible to transfer the toner image onto the recording medium with a larger amount of charge thereon and thus with a higher transfer efficiency than ever.

The invention provides an image forming apparatus comprising:

an image bearing member which bears thereon an electrostatic latent image;

a developing section which forms a toner image by supplying toner to the electrostatic latent image formed on the image bearing member;

a transfer section which transfers the toner image formed on the image bearing member onto a recording medium;

a fixing section which allows the toner image borne on the recording medium to be fixed in place;

a cleaning section which removes and collects residual toner which remains on the image bearing member after transfer, and a third charging section which charges the residual toner which remains on the image bearing member after transfer, the third charging section being constituted by any of the charging apparatuses for charging the image bearing member.

The invention provides an image forming apparatus comprising:

an image bearing member which bears thereon an electrostatic latent image;

a developing section which forms a toner image by supplying toner to the electrostatic latent image formed on the image bearing member;

a transfer section which transfers the toner image formed on the image bearing member onto a recording medium;

a fixing section which allows the toner image borne on the recording medium to be fixed in place;

a cleaning section which removes and collects residual toner which remains on the image bearing member after transfer;

a first charging section which charges the image bearing member; and a third charging section which charges the residual toner which remains on the image bearing member after transfer, at least one of the first charging section and the third charging section being constituted by any of the charging apparatuses for charging the image bearing member.

Further, the invention provides an image forming apparatus comprising:

an image bearing member which bears thereon an electrostatic latent image;

a developing section which forms a toner image by supplying toner to the electrostatic latent image formed on the image bearing member;

a transfer section which transfers the toner image formed on the image bearing member onto a recording medium via an intermediate transfer member;

a fixing section which allows the toner image borne on the recording medium to be fixed in place;

a cleaning section which removes and collects residual toner which remains on the image bearing member after transfer; and a third charging section which charges the residual toner which remains on the image bearing member after transfer, the third charging section being constituted by any of the charging apparatuses for charging the image bearing member.

Further, the invention provides an image forming apparatus comprising:

an image bearing member which bears thereon an electrostatic latent image, a developing section which forms a toner image by supplying toner to the electrostatic latent image formed on the image bearing member, a transfer section which transfers the toner image formed on the image bearing member onto a recording medium via an intermediate transfer member;

a fixing section which allows the toner image borne on the recording medium to be fixed in place;

a cleaning section which removes and collects residual toner which remains on the image bearing member after transfer;

a first charging section which charges the image bearing member;

a second charging section which charges the toner image borne on the intermediate transfer member; and a third charging section which charges the residual toner which remains on the image bearing member after transfer, at least one of the first charging section, the second charging section, and the third charging section being constituted by any of the charging apparatuses set forth hereinabove.

According to the invention, the third charging section effects charging on the residual toner which remains on the image bearing member after the toner image formed on the image bearing member is transferred onto the recording medium or the intermediate transfer member. Accordingly, the amount of charge on the residual toner is increased, and thus the cleaning of the residual toner can be achieved with efficiency.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
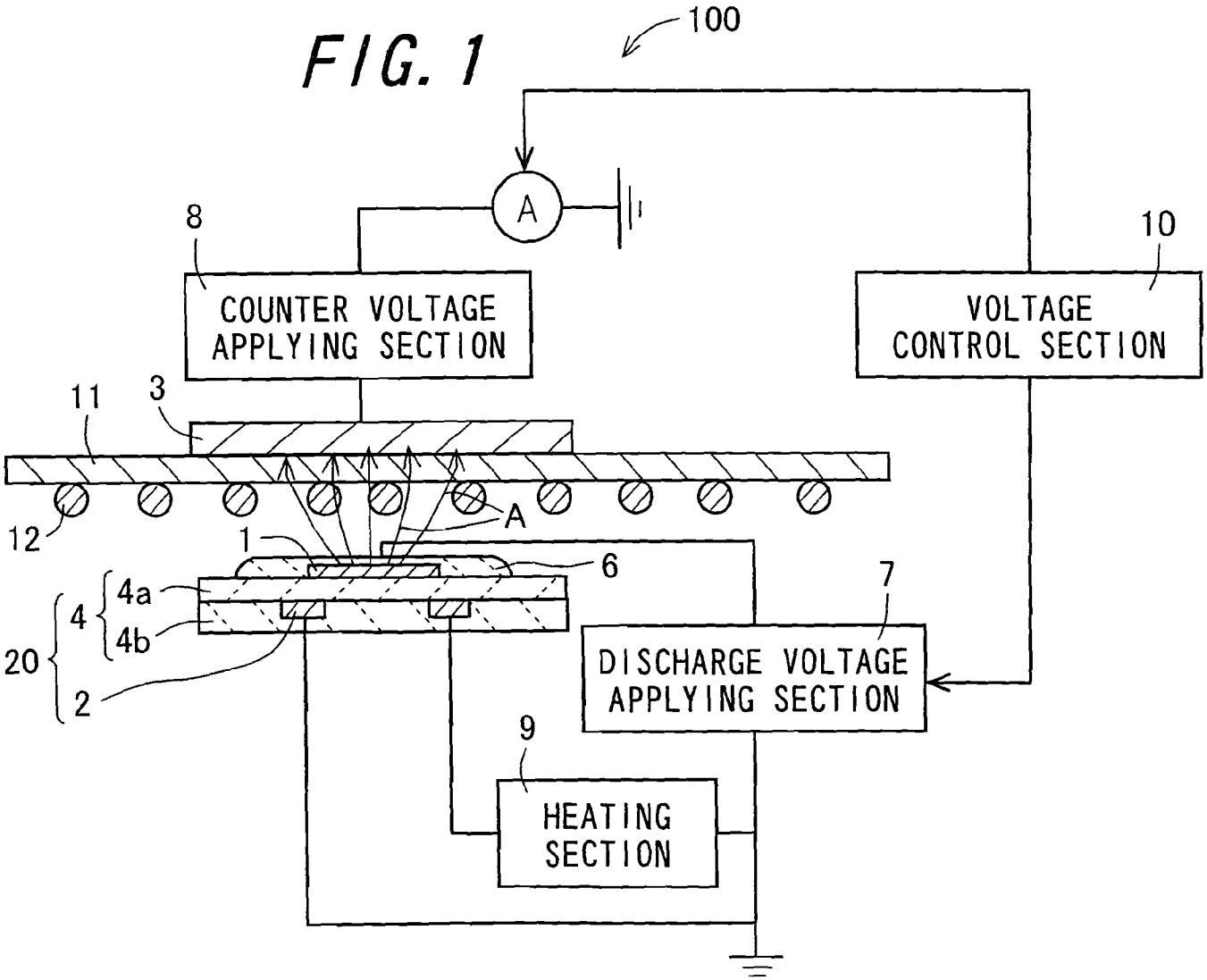
FIG. 1 is a view showing the constitution of a charging apparatus in accordance with a first embodiment of the invention.

Now referring to the drawings, preferred embodiments of the invention are described below.

Figure 2A:
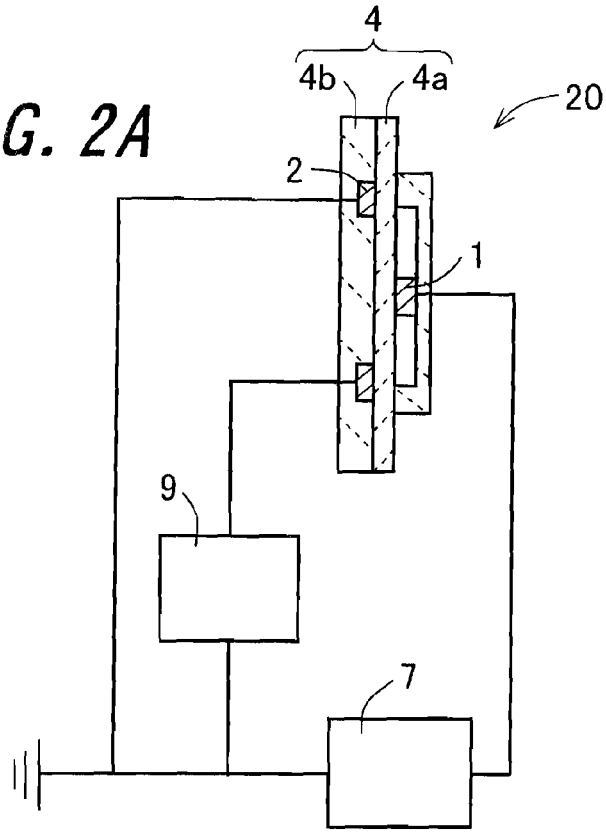
FIGS. 2A and 2B are views showing the structure of an ion generating section.
Figure 2B:
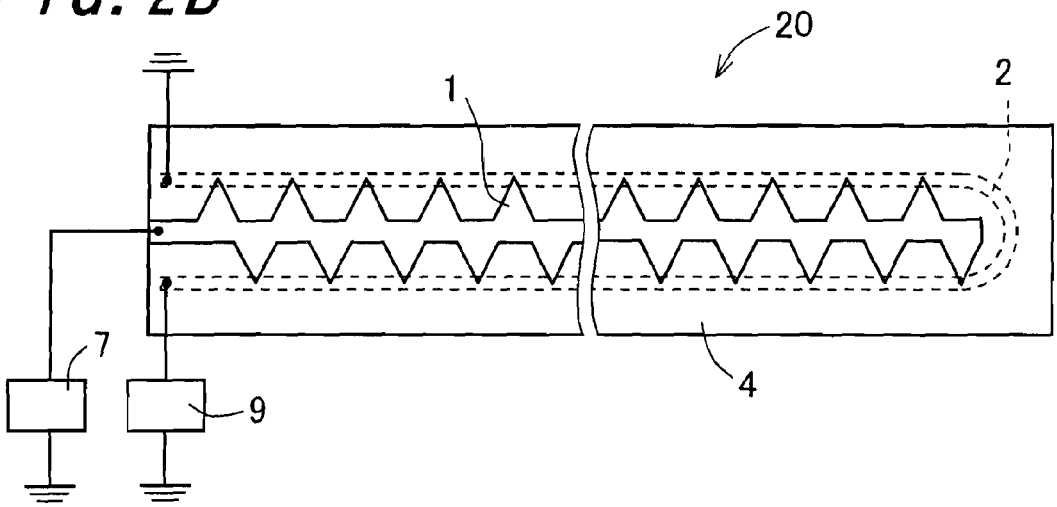

FIG. 1 is a view showing the constitution of a charging apparatus 100 in accordance with a first embodiment of the invention. Moreover, FIGS. 2A and 2B are views showing the structure of an ion generating section 20. The charging apparatus 100 performs charging on a target object to be charged, namely a to-be-charged body 11. In a case where a toner image is formed on the to-be-charged body 11, toner 12 existing on the to-be-charged body 11 is subjected to charging. The charging apparatus 100 is composed of the ion generating section 20, a counter electrode 3, and a voltage control section 10.

The ion generating section 20 is a component to generate an ion for charging the to-be-charged body 11, and is composed of a dielectric body 4, a discharge electrode 1, an induction electrode 2, and a protective layer 6. The dielectric body 4 is constructed of a flat plate formed by bonding substantially rectangular-shaped upper and lower dielectrics 4*a* and 4*b* together. As a material for forming the dielectric body 4, in the case of using an organic substance, the one which is excellent in oxidation resistance is suitable for use. For example, a resin material such as polyimide and glass epoxy can be used. On the other hand, in the case of selecting an inorganic substance as the material for forming the dielectric body 4, it is possible to use mica, high purity alumina, crystallized glass, and a ceramics such as forsterite and steatite. With consideration given to corrosion resistance, the use of an inorganic substance is more desirable to form the dielectric body 4. Moreover, with consideration given to moldability and subsequently-described easiness in electrode construction, resistance to moisture, and other factors, it is desirable to form the dielectric body 4 with use of a ceramics. Further, in light of the fact that it is desirable to keep insulation resistance between the discharge electrode 1 and the induction electrode 2 uniform, the dielectric body 4 should preferably be made of a material which incurs lesser degree of internal density variation and provides a uniform insulation rate for the dielectric body 4.

The discharge electrode 1 is formed on the surface of the upper dielectric 4*a* integrally with the upper dielectric 4*a*. Although there is no particular limitation to a material used for forming the discharge electrode 1 so long as it exhibits electrical conductivity, for example, tungsten, silver, and stainless-steel, the material for use is required to satisfy a condition that it is undeformable, for example, it is free from discharge induced meltage. In a case where the discharge electrode 1 is so disposed as to protrude from the surface of the upper dielectric 4*a*, it is preferable that the discharge electrode 1 has a uniform thickness. On the other hand, in a case where the discharge electrode 1 is disposed in the upper dielectric 4*a* interiorly thereof, it is preferable that the discharge electrode 1 is arranged at a uniform depth below the surface of the upper dielectric 4*a*. In this embodiment, the discharge electrode 1 is formed of a material made from tungsten and stainless steel and is so disposed as to protrude from the surface of the upper dielectric 4*a*. In regard to the configuration of the discharge electrode 1, as will hereinafter be described in detail, the discharge electrode 1 can be formed in any given shape so long as it extends in a direction perpendicular to a direction in which the to-be-charged body 11 is moved between the ion generating section 20 and the counter electrode 3 while undergoing charging, and is conformable to the surface of the to-be-charged body 11 in terms of shape. Preferably, the discharge electrode 1 is so shaped that its edge has a plurality of sharp-pointed portions so as to take on serrations.

The induction electrode 2 is formed in the dielectric body 4 interiorly thereof (formed between the upper dielectric 4*a* and the lower dielectric 4*b*) in such a manner that it is disposed face to face with the discharge electrode 1, with the dielectric body 4 lying therebetween. The reason for such an induction electrode 2 placement is that the insulation resistance between the discharge electrode 1 and the induction electrode 2 should preferably be kept uniform and that the discharge electrode 1 and the induction electrode 2 should preferably be arranged in parallel with each other. By arranging the discharge electrode 1 and the induction electrode 2 in that way, it is possible to keep the distance between the discharge electrode 1 and the induction electrode 2 (the inter-electrode distance) uniform, and thereby allow ion generation in a state where discharging is effected between the discharge electrode 1 and the induction electrode 2 with stability. Note that the induction electrode 2 may be disposed on the underside surface of the dielectric body 4 (the other surface of the dielectric body 4 opposite from the surface on which is disposed the discharge electrode 1) when the dielectric body 4 is constructed of a single layer. In this case, in order to prevent an electric current passing through the discharge electrode 1 under the application of a voltage from flowing through the induction electrode 2 by way of the dielectric body 4, there is a need to secure a sufficient creepage distance with respect to a voltage applied to the discharge electrode 1 or a need to cover the discharge electrode 1 or the induction electrode 2 with the insulating protective layer 6 which will be described later.

Just as is the case with the discharge electrode 1, there is no particular limitation to a material used for forming the induction electrode 2 so long as it exhibits electrical conductivity, for example, tungsten, silver, and stainless steel. In this embodiment, the induction electrode 2 is formed of a material made from tungsten and stainless steel. In regard to the configuration of the induction electrode 2, as will hereinafter be described in detail, in the case of forming the discharge electrode 1 in such a manner that its edge has a plurality of sharp-pointed portions so as to take on serrations, it is preferable that the induction electrode 2 is so formed as to lie only at a location facing with the sharp-pointed portions of the discharge electrode 1. Accordingly, in this case, the induction electrode 2 is so formed that its upper surface is U-shaped.

The ion generating section 20 includes a discharge voltage applying section 7 which applies a voltage between the discharge electrode 1 and the induction electrode 2. In the ion generating section 20, ions are generated under the difference in electrical potential between the discharge electrode 1 and the induction electrode 2 caused by the discharge voltage applying section 7. The discharge voltage applying section 7 is composed of an alternating-current high-voltage power supply which applies a voltage between the discharge electrode 1 and the induction electrode 2 and a voltage applying circuit acting as a circuit through which an electric current passes in accompaniment with voltage application effected by the alternating-current high-voltage power supply.

For example, in a case where both of the discharge electrode 1 and the induction electrode 2 are connected to the voltage applying circuit, the alternating-current high-voltage power supply applies a voltage to each of the discharge electrode 1 and the induction electrode 2. Moreover, in a case where the induction electrode 2 is connected to ground to have a ground potential and the discharge electrode 1 is connected to the voltage applying circuit, the alternating-current high-voltage power supply applies a voltage only to the discharge electrode 1. Further, in a case where the discharge electrode 1 is connected to ground to have a ground potential and the induction electrode 2 is connected to the voltage applying circuit, the alternating-current high-voltage power supply applies a voltage only to the induction electrode 2. In this embodiment, the discharge voltage applying section 7 applies a voltage only to the discharge electrode 1. Upon a voltage being applied to the discharge electrode 1 by the discharge voltage applying section 7 in a state where the induction electrode 2 is grounded, on the basis of the potential difference between the discharge electrode 1 and the induction electrode 2, creeping discharge takes place in the vicinity of the discharge electrode 1. With the creeping discharge, the air present around the discharge electrode 1 is ionized, thus generating negative ions.

Moreover, it is preferable that the ion generating section 20 is provided with a heating section 9 which applies heat to the dielectric body 4 and that the induction electrode 2 serves also as the heating section 9. In this embodiment, the induction electrode 2 is so formed that its upper surface is U-shaped. Moreover, the induction electrode 2 has its one end connected to a heater power source provided in the heating section 9, and has its other end grounded. Upon a voltage of predetermined level (for example, 12 V) being applied to the induction electrode 2 by the heater power source, the induction electrode 2 liberates heat through Joule heat. In this way, with the production of heat in the induction electrode 2, the dielectric body 4 is heated (to 60° C., for example) correspondingly.

The protective layer 6, which is provided to maintain insulation between the discharge electrode 1 and the induction electrode 2, is formed on the dielectric body 4 so as to cover the discharge electrode 1. For example, the protective layer 6 is made of alumina (aluminum oxide), glass, or silicon. By providing such a protective layer 6, it is possible to prevent an electric current passing through the discharge electrode 1 in a voltage-applied state from flowing into the induction electrode 2 via the dielectric body 4, and thereby maintain insulation between the discharge electrode 1 and the induction electrode 2. Moreover, since the protective layer 6 is so formed as to cover the discharge electrode 1, it is possible to protect the discharge electrode 1 against abrasion and quality degradation that are caused by discharge energy released upon the application of a voltage to the discharge electrode 1.

Hereinafter, a description will be given as to a method for manufacturing the ion generating section 20 in accordance with the present embodiment. In order to produce the ion generating section 20, at first, a 0.2 mm-thick alumina sheet made from high purity alumina is cut into, for example, a size of 9.5 mm width×320 mm length to form two components having substantially the same size; that is, the upper dielectric 4*a* and the lower dielectric 4*b*. Note that, although it is possible to use alumina having a purity of higher than or equal to 90%, in this embodiment, alumina having a purity of 92% is used to form the upper dielectric 4*a* and the lower dielectric 4*b*. Next, the tungsten-made discharge electrode 1 is formed on the top surface of the upper dielectric 4*a* by means of screen printing in such a manner that the discharge electrode 1 and the upper dielectric 4*a* are formed integrally with each other. Moreover, the tungsten-made induction electrode 2 is formed on the top surface of the lower dielectric 4*b* by means of screen printing in such a manner that the induction electrode 2 and the lower dielectric 4*b* are formed integrally with each other.

Next, on the surface of the upper dielectric 4*a* on which is formed the discharge electrode 1 is formed the alumina-made protective layer 6 so as to cover the discharge electrode 1. Subsequently, the under surface of the upper dielectric 4*a* is placed on the top surface of the lower dielectric 4*b* one upon another in such a manner that the discharge electrode 1 and the induction electrode 2 are arranged face to face with each other, with the upper dielectric 4*a* lying therebetween. Then, following the completion of pressure bonding and vacuuming, the stacked body is put into a heating furnace and fired under a non-oxidation atmosphere at 1400 to 1600° C. In this way, it is possible to form an ion generating element in which the discharge electrode 1 and the induction electrode 2 are arranged face to face with each other via the upper dielectric 4*a* in a single piece construction. After that, the discharge voltage applying section 7 is connected to the discharge electrode 1, and the heating section 9 is connected to the induction electrode 2, whereupon the ion generating section 20 can be constructed.

The counter electrode 3, which is arranged face to face with the discharge electrode 1 of the ion generating section 20, controls the flow of ions generated by the ion generating section 20. There is no particular limitation to a material used for forming the counter electrode 3 so long as it exhibits electrical conductivity, for example, tungsten, silver, and stainless steel. In this embodiment, the counter electrode 3 is formed in the shape of a plate with use of a material made from stainless steel. Moreover, a counter voltage applying section 8 is connected to the counter electrode 3. The counter voltage applying section 8 includes a counter electrode power supply which applies a voltage to the counter electrode 3. The counter electrode 3 is connected to ground through the counter electrode power supply, so that it receives application of a voltage of predetermined level through the counter electrode power supply. In the counter voltage applying section 8, a voltage of a polarity reverse to the polarity of the voltage applied to the discharge electrode 1 by the discharge voltage applying section 7 is applied to the counter electrode 3. With the counter electrode 3 thus constructed, ions generated in the vicinity of the discharge electrode 1 of the ion generating section 20 are allowed to travel toward the counter electrode 3.

In order for the to-be-charged body 11 to be charged in the charging apparatus 100, the to-be-charged body 11 is placed between the discharge electrode 1 of the ion generating section 20 and the counter electrode 3, and more specifically, arranged face to face with the discharge electrode 1 while making intimate contact with the counter electrode 3. Upon a voltage being applied to the discharge electrode 1 by the discharge voltage applying section 7, with the to-be-charged body 11 put into place in the above-described manner, discharging takes place between the discharge electrode 1 and the induction electrode 2, and creeping discharge takes place in the vicinity of the discharge electrode 1 correspondingly. In this way, since discharging takes place between the discharge electrode 1 and the induction electrode 2, it is possible to prevent generation of a corona wind that is associated with the conventional corona discharge-type charging apparatus.

The ions generated through the ionization of air around the discharge electrode 1 with the creeping discharge travel in a direction A toward the counter electrode 3, thus causing charging on the to-be-charged body 11. Since the ions generated by the ion generating section 20 travel toward the counter electrode 3 so as to charge the to-be-charged body 11, it is possible to prevent the tons from remaining in the vicinity of the discharge electrode 1. Accordingly, it never occurs that, with respect to the quantity of the ions generated by the ion generating section 20, the ones that can be utilized to charge the to-be-charged body 11 are few in quantity. This leads to enhanced ion-use efficiency. In fact, as will hereinafter be described in detail, the ion generating portion 20 is capable of generating ions in an amount required for charging the to-be-charged body 11 properly even under the condition that an applied voltage to be applied to the discharge electrode 1 is relatively small. As a result, the amount of discharge products such as ozone can be reduced.

The voltage control section 10 includes a counter electrode ammeter which measures the amount of electric current passing through the counter electrode 3. The counter electrode ammeter is connected to the counter electrode 3. As will hereinafter be described in detail, the voltage control section 10 exercises feedback control over the magnitude of a voltage which is applied by the discharge voltage applying section 7 or the counter voltage applying section 8 in such a manner that the amount of electric current passing through the counter electrode 3 is greater than or equal to the amount of electric current passing through the counter electrode 3 at the time when the amount of charge on the to-be-charged body 11 is brought to a saturating amount. The quantity of ions generated by the ion generating section 20 changes with the adhesion of foreign matters to the discharge electrode 1 and also changes according to environmental conditions under which ions are generated, etc. Moreover, for example, due to the change of wind flow in the vicinity of the discharge electrode 1 and the to-be-charged body 11, the rate at which the generated ions reach the to-be-charged body 11 is caused to vary. In this case, even if the voltage to be applied to the discharge electrode 1 is kept constant, there may be a case where the amount of charge on the to-be-charged body 11 does not remain the same. Therefore, in light of the fact that there is a correlation between the amount of charge on the to-be-charged body 11 and the amount of electric current passing through the counter electrode 3, the amount of electric current passing through the counter electrode 3 is defined as an indication to control the amount of charge on the to-be-charged body 11. On the basis of this indication, the magnitude of the voltage to be applied to the discharge electrode 1 is feedback-controlled. In this way, it is possible to impart optimal ion quantity to the to-be-charged body 11 at all times.

Figure 3A:
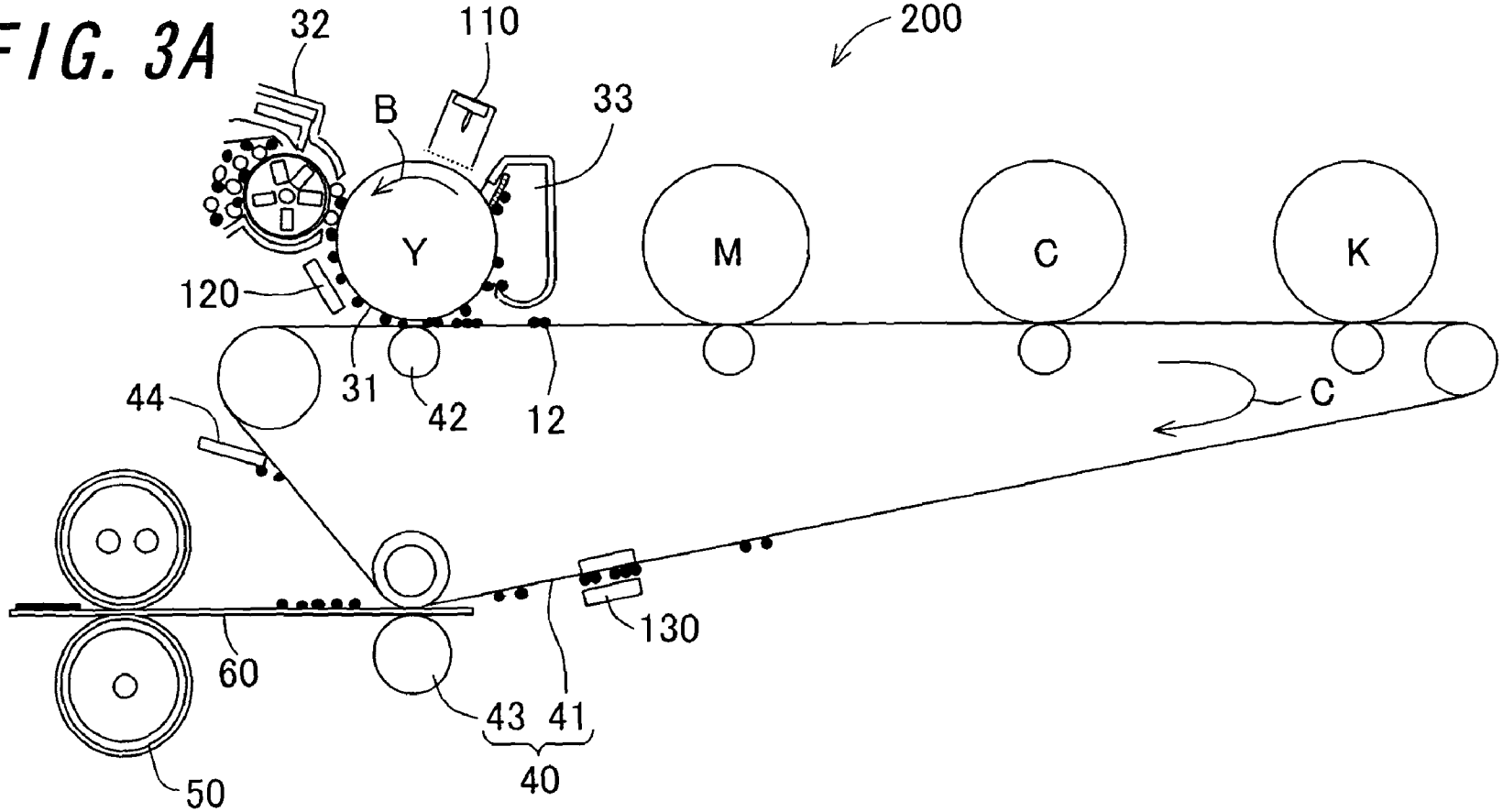
FIG. 3A is a view showing the constitution of an image forming apparatus in accordance with a second embodiment of the invention.

FIG. 3A is a view showing the constitution of an image forming apparatus 200 in accordance with a second embodiment of the invention. The image forming apparatus 200 is of a so-called tandem type and is also built as a printer that employs an intermediate transfer system to form a full-color image. The image forming apparatus 260 includes: a photoreceptor 31; a developing section 32; a transfer section 40; a fixing section 50; a photoreceptor cleaning section 33; a before-latent image-formation charging section 110; a before-intermediate-transfer charging section 120 acting as a first charging section; and a before-recording-transfer charging section 130 acting as a second charging section.

In order to deal with image data on different colors: cyan (C); magenta (M); yellow (Y); and black (K) included in color image data on an individual basis, the photoreceptor 31, a laser writing section (not shown in the figure), the developing section 32, the transfer section 40, the photoreceptor cleaning section 33, the before-latent image-formation charging section 110, and the before-intermediate-transfer charging section 120 are each correspondingly four in number. These components are arranged along a transfer belt 41.

The photoreceptor 31 is an image bearing member which bears thereon an electrostatic latent image corresponding to externally transmitted image data. The photoreceptor 31, which is so supported as to be driven to rotate about its axis by a driving mechanism (not shown), is composed of a cylindrical-shaped conductive substrate and a photosensitive layer formed on the surface of the conductive substrate. At the time of performing image formation, the photoreceptor 31 is so controlled as to rotate at a predetermined circumferential velocity (for example, 167 to 225 mm/s). An electrostatic latent image which is formed on the photoreceptor 31 is created by allowing the laser writing section (not shown) to apply laser light in accordance with externally transmitted image data. As the photoreceptor 31, any of those used customarily in this field can be used. For example, it is possible to use a photoreceptor drum composed of an aluminum base tube, which is a conductive substrate, and an organic photosensitive layer formed on the surface of the aluminum base tube. The organic photosensitive layer is formed by stacking a charge generating layer containing a charge generating substance and a charge transporting layer containing a charge transporting substance on top of each other. Alternatively, the organic photosensitive layer may be formed of a single layer containing both the charge generating substance and the charge transporting substance.

The developing section 32 turns an electrostatic latent image formed on the photoreceptor 31 into an actual image by means of toner, namely a developer. The four units of the developing sections 32 corresponding to image data of four colors are made the same, the sole difference being the color of toner for use. That is, the developing sections 32 deal with a cyan (C)-color toner, a magenta (M)-color toner, a yellow (Y)-color toner, and a black (K)-color toner, respectively. The developing section 32 is composed of a developing roller which supplies toner to the photoreceptor 31, a layer thickness regulatory member which regulates the thickness of a toner layer which is formed on the outer peripheral surface of the developing roller, an agitation/supply roller which supplies toner to the developing roller, and so forth. The photoreceptor cleaning section 33 is disposed downstream of the subsequently-described transfer section 40 with respect to a direction in which the photoreceptor 31 is rotated, namely a rotational direction 5 of the photoreceptor 31. By the photoreceptor cleaning section 33, toner left untransferred following the completion of photoreceptor 31-transfer belt 41 transfer process, namely residual toner is removed and collected from the surface of the photoreceptor 31.

Note that, the laser writing section, the developing section 32, and the photoreceptor cleaning section 33 are arranged around the photoreceptor 31, in the order named, from the upstream side to the downstream side with respect to the rotational direction B of the photoreceptor 31.

In the transfer section 40, the toner images of different colors formed on the photoreceptor 31 through the development process are transferred and overlaid onto the transfer belt 41, and the toner image thereby transferred onto the transfer belt 41 is re-transferred onto a recording sheet 60, which is a recording medium. By the transfer section 40, the toner image formed on the photoreceptor 31 receives application of an electric field of a polarity reverse to the polarity of the charge that the toner image bears, thus transferring the toner image onto the transfer belt 41. The transfer section 40 includes the transfer belt 41, an intermediate transfer section 42, a recording transfer section 43, and a transfer cleaning section 44. The transfer belt 41 is an intermediate transfer member which forms thereon a toner image, on which is transferred the toner image formed on the photoreceptor 31. The transfer belt 41 is designed as an endless belt stretched across a pair of driving rollers and an idling roller, and is so controlled that it is drivingly conveyed at a predetermined circumferential velocity (for example, 167 to 225 mm/s) at the time of image formation.

The intermediate transfer section 42 is a component to transfer the toner image formed on the photoreceptor 31 onto the transfer belt 41. The intermediate transfer section 42 includes an intermediate transfer roller which is driven to rotate about its axis. The intermediate transfer roller is arranged face to face with the photoreceptor 31, with the transfer belt 41 lying therebetween. The recording transfer section 43 is a component to re-transfer the toner image formed on the transfer belt 41 onto the recording sheet 60. The recording transfer section 43 includes two pieces of recording transfer rollers that are driven to rotate about their axes, and is so constructed that the transfer belt 41 is sandwiched between the two recording transfer rollers. Upon the recording sheet 60 fed from a paper feeding section (not shown) onto the transfer belt 41 passing through a region in which the two recording transfer rollers are kept in pressure-contact with each other, the toner image is transferred onto the recording sheet 60. The transfer cleaning section 44 is a component provided to perform cleaning on the surface of the transfer belt 41 following the completion of toner image transfer onto the recording sheet 60. Note that, the intermediate transfer section 42, the recording transfer section 43, and the transfer cleaning section 44 are arranged around the transfer belt 41, in the order named, from the upstream side to the downstream side with respect to a direction in which the transfer belt 41 is turned, namely a rotation direction C of the transfer belt 41.

The fixing section 50 is a component to allow the toner image transferred onto the recording sheet 60 to be fixed in place. The fixing section 50 is arranged on the downstream side, with respect to the recording transfer section 43, in a conveyance direction in which is conveyed the recording sheet 60. The fixing section 50 includes a heating roller and a pressurizing roller that are driven to rotate about their ages. The heating roller has a heat source disposed interiorly thereof and heats the surface of the heating roller to a fixing temperature. The pressurizing roller has, at its both ends, a pressurizing member which brings the pressurizing roller into pressure-contact with the heating roller under a predetermined pressure. In the fixing section 50, the recording sheet 60 having the toner image transferred thereon is caused to pass through a region in which the heating roller and the pressurizing roller are kept in pressure-contact with each other. At this time, by virtue of the effect of heat-fusing the toner image provided by the heating roller and the anchor effect of the toner image to the recording sheet 60 provided by the pressurizing roller, the toner image is fixed onto the recording sheet 60. The recording sheet 60 bearing the thereby formed recording image is ejected into a paper discharging section (not shown).

Moreover, the image forming apparatus 200 is provided with the before-latent image-formation charging section 110, the before-intermediate-transfer charging section 120, and the before-recording-transfer charging section 130 constituted by the charging apparatus 100 described supra. The before-latent image-formation charging section 110 is a component to charge the surface of the photoreceptor 31 which has yet to be irradiated with laser light by the laser writing section at a potential of predetermined polarity. The before-latent image-formation charging section 110 is arranged, around the photoreceptor 31, upstream of the laser writing section with respect to the rotational direction B of the photoreceptor 31. In the before-latent image-formation charging section 110, a target object to be charged, namely a to-be-charged body is the photoreceptor 31. The discharge electrode 1 of the ion generating portion 20 is thus arranged face to face with the photoreceptor 31. Moreover, in the before-latent image-formation charging section 110, the photoreceptor 31 is so designed as to serve also as a counter electrode. In the before-latent image-formation charging section 110, the ions generated from the ion generating section 20 flow toward the photoreceptor 31 serving also as a counter electrode, thus effecting charging on the surface of the photoreceptor 31 rotating about its axis.

The before-intermediate-transfer charging section 120 is a component to charge the toner image formed on the photoreceptor 31. The before-intermediate-transfer charging section 120 is arranged, around the photoreceptor 31, downstream of the developing section 32 with respect to the rotational direction B of the photoreceptor 31. In the before-intermediate-transfer charging section 120, a target object to be charged, namely a to-be-charged body is the toner image formed on the photoreceptor 31. The discharge electrode 1 of the ion generating section 20 is thus arranged face to face with the photoreceptor 31. Moreover, in the before-intermediate-transfer charging section 120, the photoreceptor 31 is so designed as to serve also as a counter electrode. In the before-intermediate transfer charging section 120, the ions generated from the ion generating section 20 flow toward the photoreceptor 31 serving also as a counter electrode, thus effecting charging on the toner image formed on the photoreceptor 31 rotating about its axis.

The before-recording-transfer charging section 130 is a component to charge the toner image transferred onto the transfer belt 41. The before-recording-transfer charging section 130 is arranged, around the transfer belt 41, upstream of the recording transfer section 43 with respect to the rotation direction C of the transfer belt 41. In the before-recording-transfer charging section 130, a target object to be charged, namely a to-be-charged body is the toner image formed on the transfer belt 41. The transfer belt 41 is thus located between the discharge electrode 1 of the ion generating section 20 and the counter electrode 3, and more specifically, arranged face to face with the discharge electrode 1 while making intimate contact with the counter electrode 3. In the before-recording-transfer charging section 130, the ions generated from the ion generating section 20 flow toward the counter electrode 3, thus effecting charging on the toner image formed on the transfer belt 41 moving at a predetermined circumferential velocity.

In this way, in the image forming apparatus 200, its charging section which charges the toner image formed on the photoreceptor 31 acting as an image bearing member, as well as the toner image formed on the transfer belt 41 acting as an intermediate transfer member, is constituted by the charging apparatus 100 which is capable of preventing generation of discharge products such as ozone. This makes it possible to protect the photoreceptor 31 and the transfer belt 41 against the adhesion of discharge products. Accordingly, as will hereinafter be described in detail, at the time when a recording image is formed on the recording sheet 60 by the image forming apparatus 200, it is possible to prevent occurrence of image imperfection, such as a white patch or friar and image deletion, caused by the adhesion of discharge products to the photoreceptor 31 or the transfer belt 41. Moreover, since generation of highly oxidative ozone can be prevented, it is possible to prevent occurrence of oxidation-induced quality degradation in the components constituting the image forming apparatus 200.

Moreover, the before-intermediate-transfer charging section 120 and the before-recording-transfer charging section 130 provided in the image forming apparatus 200 are constituted by the charging apparatus 100. In this case, generation of a corona wind can be prevented. Therefore, it never occurs that the toner image formed on the photoreceptor 31, as well as the one formed on the transfer belt 41, is charged in a distorted state. Further, as will hereinafter be described in detail, since the before-intermediate-transfer charging section 120 and the before-recording-transfer charging section 130 act to charge a toner image, it is possible to increase the amount of charge on the toner image and thereby transfer the toner image with enhanced transfer efficiency.

Moreover, in the image forming apparatus 200, its charging section which charges the photoreceptor 31 and the transfer belt 41 is constituted by the charging apparatus 100 that succeeds in offering high ion-use efficiency. Therefore, even if the photoreceptor 31 and the transfer belt 41 are driven at high speed, they can be charged satisfactorily. That is, the charging section constituted by the charging apparatus 100 is applicable to a high-speed image forming apparatus for performing printing operations at high speed.

Figure 3B:
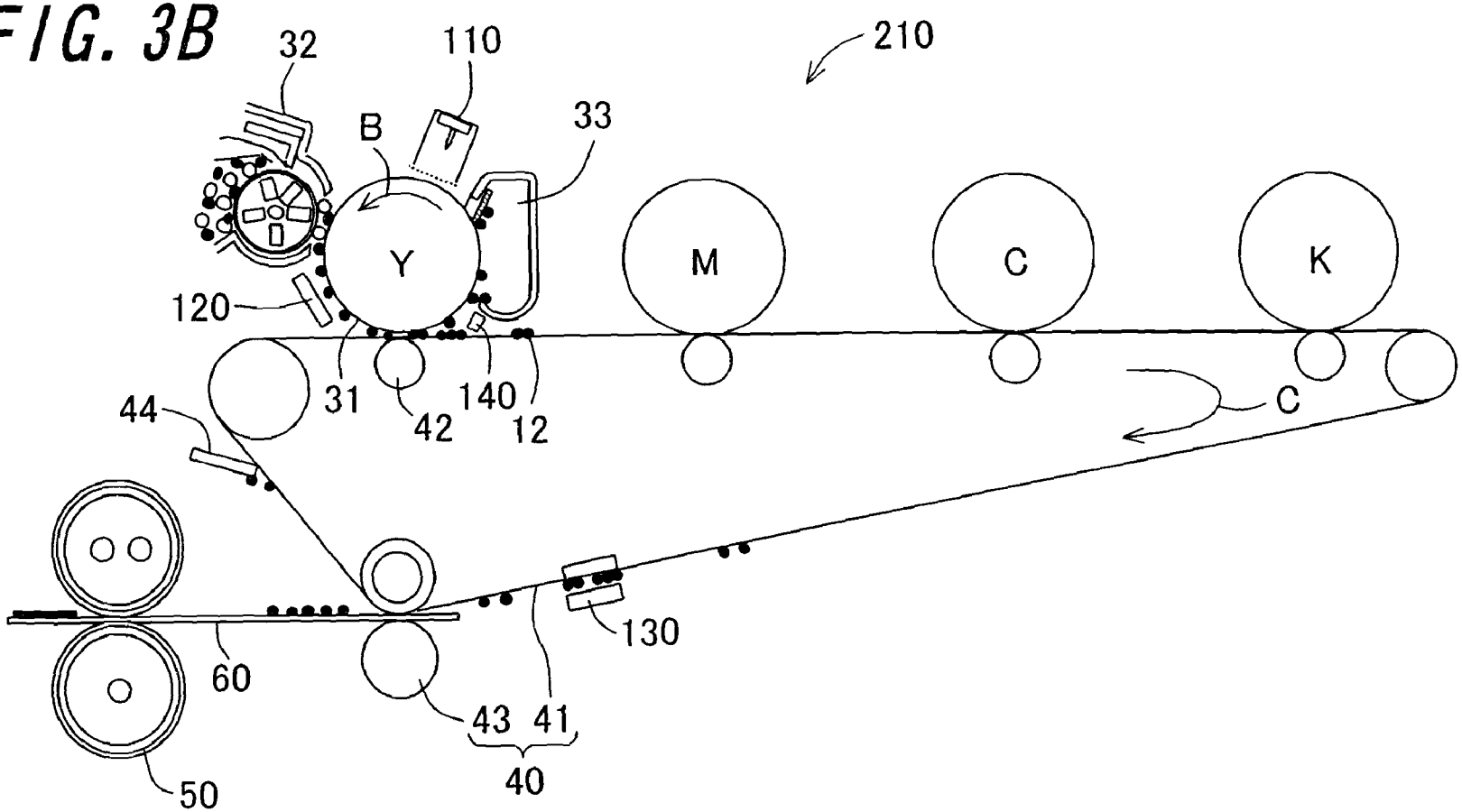
FIG. 3B is a view showing the constitution of an image forming apparatus in accordance with a third embodiment of the invention.

FIG. 3B is a view showing the constitution of an image forming apparatus 210 in accordance with a third embodiment of the invention. The image forming apparatus 210 is made the same as the image forming apparatus 200, except that, in the former, there is disposed a before-cleaning charging section 140 between the transfer section 40 and the photoreceptor cleaning section 33. The before-cleaning charging section 140, which acts as a third charging section, is constituted by the above-described charging apparatus 100. Herein, such constituent components as are common to those in the image forming apparatus 200 will be denoted by the same reference numerals and symbols, and overlapping descriptions will be omitted.

The before-cleaning charging section 140 is a component to charge toner left untransferred after the photoreceptor 31-transfer belt 41 transfer process, namely residual toner. In the before-cleaning charging section 140, a target object to be charged, namely a to-be-charged body is the residual toner image remaining on the photoreceptor 31. The discharge electrode 1 of the ion generating section 20 is thus arranged face to face with the photoreceptor 31. Moreover, in the before-cleaning charging section 140, the photoreceptor 31 is so designed as to serve also as a counter electrode. In the before-cleaning charging section 140, the ions generated from the ion generating section 20 flow toward the photoreceptor 31 serving also as a counter electrode, thus effecting charging on the residual toner image remaining on the photoreceptor 31 rotating about its axis. In this way, the amount of charge on the residual toner is increased, and thus the residual toner can be removed and collected efficiently by the photoreceptor cleaning section 33.

The image forming apparatus 210, although it is illustrated as having the transfer belt 41 in FIG. 3B, may be constructed as an image forming apparatus in which transfer to the recording sheet 60 is effected directly by the transfer section 40 without the provision of the transfer belt 41. Moreover, the image forming apparatus 210, although it is illustrated as having, in addition to the before-cleaning charging section 140, the before-intermediate-transfer charging section 120 and the before-recording-transfer charging section 130, may be designed to have only the before-cleaning charging section 140, or may be designed to have the before-cleaning charging section 140 and one of the before-intermediate-transfer charging section 120 and the before-recording-transfer charging section 130. Further, it is possible to dispose an additional charging section which charges the residual toner remaining on the transfer belt 41 in front of the transfer cleaning section 44 disposed on the transfer belt 41, namely on the upstream side in the rotation direction C of the transfer belt 41.

Hereinafter, the relationship between the structure and the characteristics of the charging apparatus will be described in further detail with reference to the charging apparatus 100 used as the before-recording-transfer charging sections (Configurations of Discharge Electrode and Induction Electrode)

Figure 4A:
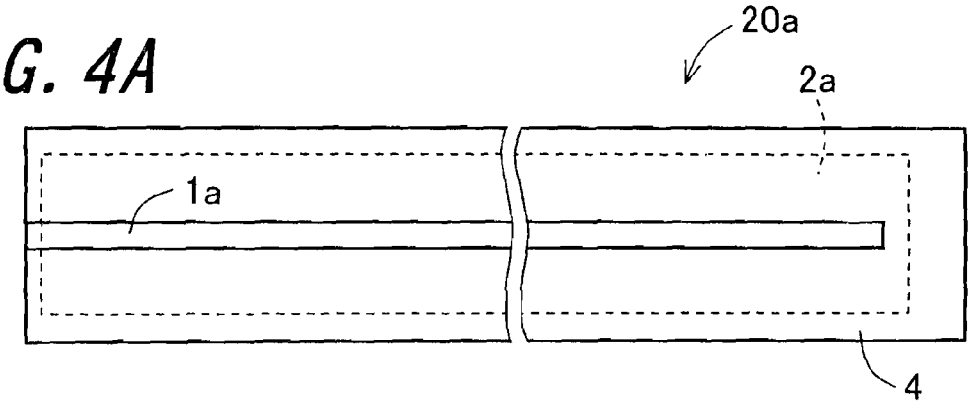
FIGS. 4A through 4C are views showing the electrode configurations of ion generating sections.
Figure 4B:
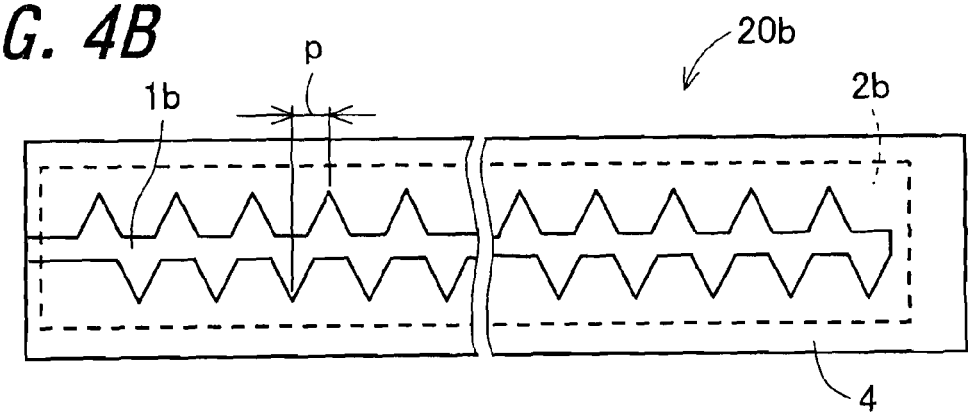
Figure 4C:
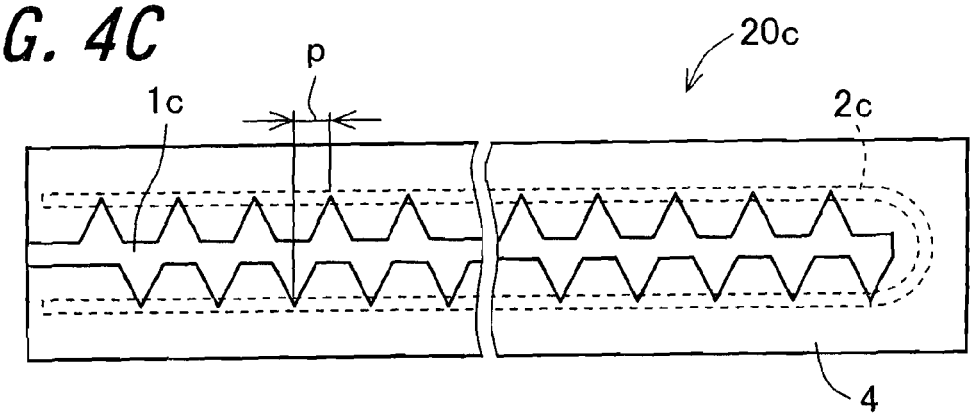
Figure 5:
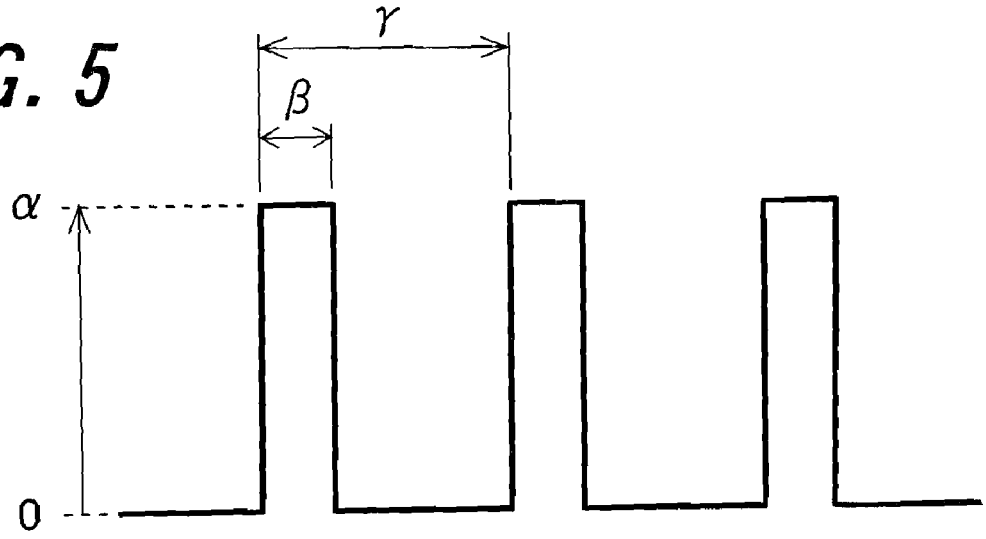
FIG. 5 is a view showing the waveform of an applied voltage.

FIGS. 4A through 4C are views showing the electrode configurations of ion generating sections 20*a*, 20*b*, and 20*c*. Moreover, FIG. 5 is a view showing the waveform of an applied voltage. The ion generating sections 20*a*, 20*b*, and 20*c* are similar in construction to the above-described ion generating section 20, the only difference being the configurations of the discharge electrode and induction electrode thereof. In the ion generating section 20*a*, as shown in FIG. 4A, a discharge electrode 1*a* is formed in the shape of a rectangular plate, and an induction electrode 2*a* is formed in the shape of a rectangular plate so as to face the entire surface of the discharge electrode 1*a*, with the dielectric body 4 lying therebetween. Moreover, the dielectric body 4 has a size of 0.2 mm thickness×8.5 mm width×50 mm length.

In the ion generating section 20*b*, as shown in FIG. 45, a discharge electrode 1*b* is formed of a rectangular plate-like body whose edge has a plurality of sharp-pointed portions so as to take on serrations, and an induction electrode 2*k* is formed in the shape of a rectangular plate so as to face the entire surface of the discharge electrode 1*b*, with the dielectric body 4 lying therebetween. Note that the interval between the tips of two sharp-pointed portions of the discharge electrode 1*b*, namely a pointedness pitch p, is set at 1 mm. Moreover, the dielectric body 4 has a size of 0.2 mm thickness×8.5 mm width×50 mm length. In the ion generating section 20*c*, as shown in FIG. 4C, a discharge electrode 1*c* is formed of a rectangular plate-like body whose edge has a plurality of sharp-pointed portions so as to take on serrations, and an induction electrode 2*c* is U-shaped so as to lie only at a location facing with the sharp-pointed portions of the discharge electrode 1*c*, with the dielectric body 4 lying therebetween. Note that the interval between the tips of two sharp-pointed portions of the discharge electrode 1*c*, namely a pointedness pitch p, is set at 1 mm. Moreover, the dielectric body 4 has a size of 0.2 mm thickness×8.5 mm width×50 mm length.

The ion generating sections 20*a*, 20*b*, and 20*c* of three different types described supra are placed inside a chamber (a bath with constant temperature and humidity) having a volumetric capacity of 1 $m^3$. A counter electrode (made from stainless steel) is arranged in parallel with each of the discharge electrodes 1*a*, 1*b*, and 1*c* provided separately for the individual ion generating sections, with a gap of 5 mm secured therebetween. In this state, an alternating-current voltage having a waveform with such a peak voltage ($\alpha$) and duty ratio ($\beta/\gamma$) as shown in FIG. 5 is applied to each of the discharge electrodes 1*a*, 1*b*, and 1*c* so as for a counter electrode current of 1.2 μA to pass through the counter electrode. The applied voltage conditions and results of ozone generation measurement associated with this experiment are listed in Table 1. Note that the ozone generation measurement is conducted, with use of an ozone measuring instrument (Ozone Monitor, type EG 2002F manufactured by Ebara Jitsugyo, Co., Ltd.), to measure the concentration of ozone within the chamber after 5 minutes have elapsed from the time of the start of voltage application.

As will be understood from Table 1, as compared with the ion generating section 20*a*, in the ion generating sections 20*b* and 20*c*, the same counter electrode current as that obtained in the ion generating section 20*a* can be obtained at a lower peak voltage or frequency. This is because, by imparting a serrated shape to the edge of the discharge electrode, the convergence of electric field takes place between the sharp-pointed portions of the discharge electrode and the induction electrode, in consequence whereof discharging tends to occur between the discharge electrode and the induction electrode. Accordingly, the same counter electrode current can be obtained at a decreased applied voltage or frequency. As a result, it is possible to reduce electric power consumption, as well as to prolong the service lifespan of the discharge electrode.

Moreover, in the ion generating section 20*c*, an ozone generation amount is reduced compared to the ion generating sections 20*a* and 20*b*. This is because, as has already been described, the applied voltage and frequency can be set at a lower level in the ion generating section 20*c*. On the other hand, in the ion generating section 20*b*, although it allows a decrease in frequency in contrast to the ion generating section 20*a*, no reduction in ozone generation amount is observed compared to the ion generating section 20*a*. This is because the ozone generation amount is related not only to the applied voltage and frequency for the discharge electrode but also to the area of discharging. That is, the circumferential length of a discharge region (the perimeter of a discharge surface on which discharging occurs), which is defined as an indication to determine the area of discharging, in ascending order is; the ion generating section 20*c*, the ion generating section 20*a*, and the ion generating section 20*b*. For this reason, in the ion generating section 20*b*, although it allows a decrease in frequency in contrast to the ion generating section 20*a*, no reduction in the ozone generation amount is observed compared to the ion generating section 20*a*.

Herein, regarding a theoretical value of ozone generation amount that is calculated based on the assumption that the ozone generation amount is proportional to an effective voltage (peak voltage-discharge inception voltage), frequency, a counter electrode current, and a discharge-region perimeter, given the theoretical value in the ion generating section 20*a* of 1, then the following relative ratio holds: the theoretical value in the ion generating section 20*b* is 1.12 and the theoretical value in the ion generating section 20*c* is 0.30. In terms of relative ratio, these theoretical values of ozone generation amount coincide substantially with the actually measured values of the amount of ozone generated in the ion generating sections 20*a*, 20*b*, and 20*c*, respectively. It will thus be seen that the ozone generation amount is proportionally related not only to the applied voltage and frequency for the discharge electrode but also to the area of discharging.

As described heretofore, in the case of obtaining the same discharge current (counter electrode current), by forming the discharge electrode in such a manner that its edge has a plurality of sharp-pointed portions so as to take on serrations, it is possible to decrease the applied voltage and frequency for the discharge electrode. Moreover, by forming the induction electrode in such a manner as to lie only at a location facing with the sharp-pointed portions of the discharge electrode, it is possible to reduce the area of discharging and thereby reduce the ozone generation amount.

TABLE 1

| | Ion generating section | | |
|---|---|---|---|
| | Ion generating section 20a | Ion generating section 20b | Ion generating section 20c |
| Waveform | Rectangular wave | Rectangular wave | Rectangular wave |
| Peak voltage (α) [−kV] | 4 | 4 | 3.5 |
| Discharge inception voltage[−kV] | 2.73 | 2.57 | 2.75 |
| Frequency [kHz] | 3 | 2 | 2 |
| Duty (β/γ) [%] | 20 | 20 | 20 |
| Discharge-region perimeter [mm] | 88 | 131 | 67.2 |
| Counter electrode current [μA] | 1.2 | 1.2 | 1.2 |
| Actual measurement value of ozone generation amount [ppm] | 0.219 | 0.245 | 0.076 |
| Actual measurement value of ozone generation amount (ratio) | 1 | 1.12 | 0.35 |
| Theoretical value of ozone generation amount (ratio) | 1 | 1.12 | 0.3 |

(Relationship Between Pointedness Pitch and Discharge Electrode-to-Transfer Belt Distance)

There are fabricated ion generating sections of five different types that are similar in construction to the ion generating section 20*c*, the discharge electrodes of which are each formed of a rectangular plate-like body whose edge has a plurality of sharps pointed portions so as to take on serrations. The difference from the ion generating section 20*c* is the pointedness pitch p of the discharge electrode (there are five levels: 10 mm; 5 mm; 1 mm; 0.3 mm; and 0.15 mm). The ion generating sections of five types are placed inside a chamber (a bath with constant temperature and humidity) having a volumetric capacity of 1 $m^3$. A counter electrode (made from stainless steel) is arranged opposedly to each of the discharge electrodes provided separately for the individual ion generating sections, with gaps g of 7 mm, 5 mm, and 3 mm, respectively, secured therebetween. In this state, an alternating-current voltage is applied to each of the discharge electrodes so as for a counter electrode current of 1.2 μA to pass through the counter electrode. At this time, the ozone generation amount is measured in a manner similar to that described supra. The results of the ozone generation measurement are listed in Table 2. Note that, in Table 2, in addition to the actual measurement numerical values of ozone generation amount, evaluations of these values are listed. That is, under the comparison with the ozone generation amount as observed in the conventional corona discharge-type charging section: 0.3 ppm, the case judged as being smaller in ozone generation amount is represented by "Good", whereas the case judged as being larger in ozone generation amount is represented by "Poor".

Moreover, before-recording-transfer charging sections are formed with use of the ion generating sections of five types thus constructed. These before-recording-transfer charging sections are applied to, as an image forming apparatus, Color Multifunction Printer MX-4500 manufactured by SHARP CORPORATION. Note that, in each of the before-recording-transfer charging sections, its ion generating section is arranged face to face with the transfer belt in such a manner that there is a certain gap g (7 mm, 5 mm, and 3 mm, respectively) between the discharge electrode and the transfer belt, and the counter electrode is arranged face to face with the discharge electrode, with the transfer belt lying therebetween, while making intimate contact with the transfer belt. In this state, an alternating-current voltage is applied to the discharge electrode so as for a counter electrode current of 1.2 μA to pass through the counter electrode. At this time, in the image forming apparatus, a black-color solid image is being printed onto a recording sheet. Then, the presence or absence of a white stripe on the recording sheet is examined, and the results of the examinations are listed in Table 2. Therein, the absence of a white stripe on the recording sheet is represented by "Good", whereas the presence of a white stripe thereon is represented by a symbol "Poor".

As will be understood from Table 2, no white stripe appears when the ratio between the pointedness pitch p and the gap g: "p/g" stands at or below 1. This is because, by setting "p/g" to be smaller than or equal to 1, it is possible to set the pointedness pitch p at a relatively small value or to adjust the gap g at a relatively large value. In this case, since variation in charging ascribed to the pointedness pitch can be prevented from occurring on the transfer belt, it is possible for the transfer belt to be charged uniformly. Moreover, when "p/g" stands at or above 0.06, the ozone generation amount can be kept lower than in the conventional corona discharge-type charging section. This is because, by setting "p/g" to be larger than or equal to 0.06, it is possible to adjust the area of discharging to be small with an increased pointedness pitch p or to adjust an applied voltage to be applied to the discharge electrode to be small with a decreased gap p.

In light of the results described heretofore, it is desirable to set "p/g" in a range of from 0.06 to 1. By setting "p/g" in this way, it is possible to prevent occurrence of image imperfection such as a white stripe, as well as to reduce the ozone generation amount.

TABLE 2

| Pitch p | Gap g | | | Ozone generation amount | |
|---|---|---|---|---|---|
| [mm] | [mm] | p/g | White stripe | | [ppm] |
| 0.15 | 7 | 0.02 | Good | Poor | 0.7093 |
| 0.15 | 5 | 0.03 | Good | Poor | 0.5067 |
| 0.3 | 7 | 0.04 | Good | Poor | 0.3547 |
| 0.15 | 3 | 0.05 | Good | Poor | 0.3040 |
| 0.3 | 5 | 0.06 | Good | Good | 0.2533 |
| 0.3 | 3 | 0.10 | Good | Good | 0.1520 |
| 1 | 7 | 0.14 | Good | Good | 0.1064 |
| 1 | 5 | 0.20 | Good | Good | 0.0760 |
| 1 | 3 | 0.33 | Good | Good | 0.0456 |
| 5 | 7 | 0.71 | Good | Good | 0.0213 |
| 5 | 5 | 1.00 | Good | Good | 0.0152 |
| 10 | 7 | 1.43 | Poor | Good | 0.0106 |
| 5 | 3 | 1.67 | Poor | Good | 0.0091 |
| 10 | 5 | 2.00 | Poor | Good | 0.0076 |
| 10 | 3 | 3.33 | Poor | Good | 0.0046 |

(Number of Discharge Electrode and Material Used for Dielectric Body)

Figure 6A:
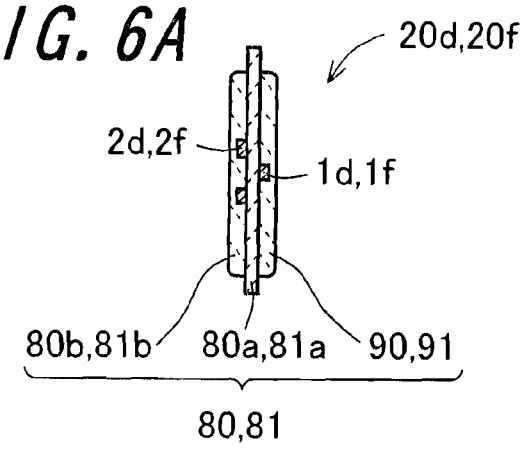
FIGS. 6A through 6C are views showing the electrode configurations of ion generating sections.
Figure 6B:
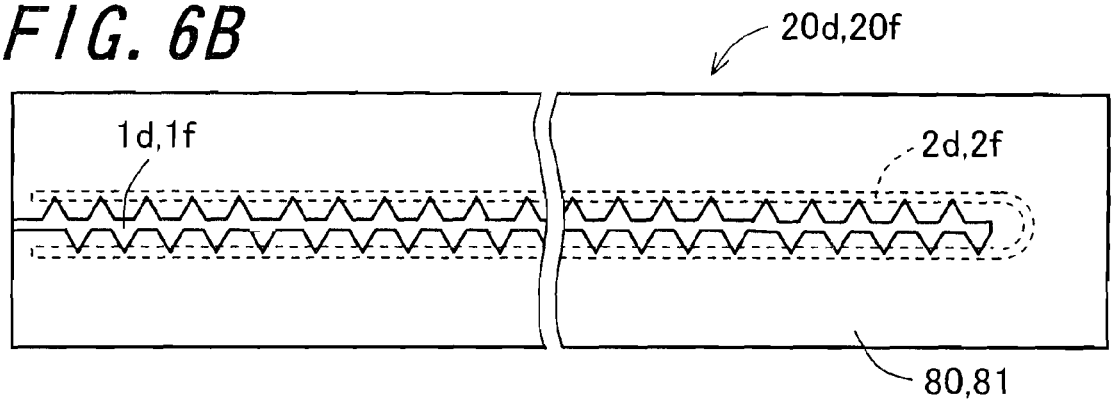
Figure 6C:
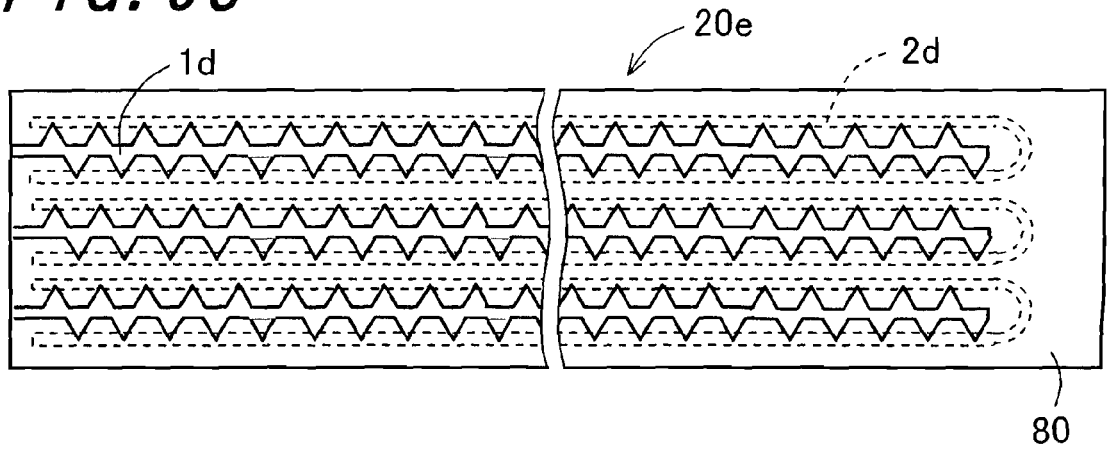

FIGS. 6A through 6C are views showing the electrode configurations of ion generating sections 20*d*, 20*e*, and 20*f*. In the ion generating section 20*d*, as shown in FIGS. 6A and 6B, a discharge electrode 1*d* (made from stainless steel) is formed of a rectangular plate-like body whose edge has a plurality of sharp-pointed portions so as to take on serrations, and an induction electrode 2*d* is U-shaped so as to lie only at a location facing with the sharp-pointed portions formed in the discharge electrode 1*d*, with a dielectric body 80 lying therebetween. In this construction, the pointedness pitch of the sharp-pointed portions of the discharge electrode 1*d* is set at 0.15 mm. Note that the dielectric body 80 is composed of an upper dielectric 80*a* and a lower dielectric 80*b*. The upper dielectric 80*a* is formed of a 80 μm-thick mica-made sheet, whereas the lower dielectric 80*b* is formed of a 80 μm-thick silicon-made sheet. The upper dielectric 80*a* and the lower dielectric 80*b* have substantially the same size; 8.5 mm width×320 mm length. Moreover, on the surface of the upper dielectric 80*a* is formed a glass-made protective layer 90 so as to cover the discharge electrode 1*d*.

The ion generating section 20*e* is similar in construction to the ion generating section 20*d*, the differences being the number of discharge electrode and the number of induction electrode. In the ion generating section 20*e*, as shown in FIG. 6C, three pieces of discharge electrodes and three pieces of induction electrodes, each of which is identical with that of the ion generating section 20*d*, are formed on the dielectric body 80. The ion generating section 20*f* is similar in construction to the ion generating section 20*d*, the differences being materials used for discharge electrode, dielectric body, and protective layer. The discharge electrode 1*f* of the ion generating section 20*f* is made of tungsten, and the protective layer 91 thereof is made of alumina. Moreover, the dielectric body 81 of the ion generating section 20*f* is composed of an upper dielectric 81*a* and a lower dielectric 81*b*. The upper dielectric 81*a* and the lower dielectric 81*b* are each formed of a 200 μm-thick alumina-made sheet.

By using the ion generating sections 20*d*, 20*e*, and 20*f* thus constructed, before-recording-transfer charging sections are formed and applied to, as an image forming apparatus, Color Multifunction Printer MX-4500 manufactured by SHARP CORPORATION. Note that, in each of the before-recording-transfer charging sections, the discharge electrode of the ion generating section is arranged face to face with the transfer belt, and the counter electrode is arranged face to face with the discharge electrode, with the transfer belt lying therebetween, while making intimate contact with the transfer belt. In this state, an alternating-current voltage is applied to the discharge electrode so as for a counter electrode current of 10 μA to pass through the counter electrode. At this time, in the image forming apparatus, black-color solid images are being continuously printed onto recording sheets under environmental conditions of high temperature and high humidity (35° C., 80%) to examine the appearance of a white stripe in relation to the number of printouts. The results of the examination are listed in Table 3, wherein the absence of a white stripe on the recording sheet is represented by "Good", whereas the presence of a white stripe is represented by "Poor". Note that, in performing this evaluation process, the operation of the image forming apparatus is brought to a halt upon the appearance of a white stripe to stop printing on the recording sheet.

As will be understood from Table 3, in the case of using the before-recording-transfer charging section having the ion generating section 20*e*, as compared with the case of using the before-recording-transfer charging section having the ion generating section 20*d*, it is possible to obtain a larger number of printouts by the time when a white stripe appears. This is because the ion generating section 20*e* is larger in discharge electrode number than the ion generating section 20*d*. That is, since the electric current density per discharge electrode is decreased, it is possible to prevent abrasion and quality degradation on a per discharge electrode basis and the adhesion of discharge products to the discharge electrode as well. Accordingly, with the provision of a plurality of discharge electrodes, the service lifespan of each of the discharge electrodes can be prolonged.

Moreover, in the case of using the before-recording-transfer charging section having the ion generating section 20*f*, as compared with the case of using the before-recording-transfer charging section having the ion generating section 20*d*, it is possible to obtain a larger number of printouts by the time when a white stripe appears. This is because, while the upper dielectric 80*a* provided in the ion generating section 20*d* is made of mica, the upper dielectric 81*a* provided in the ion generating section 20*f* is made of alumina, namely, a ceramics. That is, the mica used as a material to form the upper dielectric 80*a* of the ion generating section 20*d* is aggregate-type mica obtained by compressing mica scales with an adhesive. It is therefore highly hygroscopic and absorbs moisture under high-humidity environment. By way of contrast, the alumina used as a material to form the upper dielectric 81*a* of the ion generating section 20*f* has a low hygroscopic nature and seldom absorbs moisture even under high-humidity environment. Accordingly, in the before-recording-transfer charging section having the ion generating section 20, it is possible to prevent occurrence of a decline in discharging capability caused by the moisture absorptive action of the dielectric body, and thereby generate ions required to charge the transfer belt with stability even under high-humidity environment.

Moreover, there is fabricated an ion generating section 20*g* which is similar in construction to the ion generating section 20*f* except for the absence of protective layer in the former. In the case of using the before-recording-transfer charging section having the ion generating section 20*g*, although not described in Table 3, the number of printouts obtained by the time when a white stripe appears is fewer than in the case of using the before-recording-transfer charging section having the ion generating section 20. This is because the ion generating section 20*g* has no protective layer for covering the discharge electrode. In this case, the discharge electrode is susceptible to abrasion and quality degradation. Accordingly, with the provision of a protective layer for covering the discharge electrode, the discharge electrode can be protected from abrasion and quality degradation and thus offer a longer service lifespan,

TABLE 3

| | | | Ion generating section | | |
|---|---|---|---|---|---|
| | | | Ion generating section 20d | Ion generating section 20e | Ion generating section 20f |
| Dielectric material | | | Mica | Mica | Alumina |
| Discharge electrode number | | | 1 | 3 | 1 |
| Pitch p [mm] | | | 0.15 | 0.15 | 0.15 |
| Peak voltage (α) [−kV] | | | 3 | 3 | 3.5 |
| Frequency [kHz] | | | 0.5-1.2 | 0.75-1.2 | 0.75-1.2 |
| Duty (β/γ) [%] | | | 20 | 20 | 20 |
| Counter electrode current [μA] | | | 10 | 10 | 10 |
| White stripe | Number of printout | 0 | Good | Good | Good |
| | | 5000 | Poor | Good | Good |
| | | 10000 | — | Good | Good |
| | | 30000 | — | Poor | Good |
| | | 50000 | — | — | Good |

(Effect of Counter Electrode)

The before-recording-transfer charging section having the ion generating section is applied to, as an image forming apparatus, Color Multifunction Printer MX-4500 manufactured by SHARP CORPORATION. The ion generating section is arranged face to face with the transfer belt, with a gap of 5 mm secured between the discharge electrode and the transfer belt, and the counter electrode is arranged face to face with the discharge electrode, with the transfer belt lying therebetween, while making intimate contact with the transfer belt. In this state, an alternating-current voltage is applied to the discharge electrode to generate ions, so that the transfer belt is subjected to ion irradiation. At this time, in the image forming apparatus, the transfer belt is so controlled that it is drivingly conveyed at a circumferential velocity of o 225 mm/s, and solid images (black and cyan) having adherent toner amount of 0.4 mg/cm$^2$ are being printed onto recording sheets. Listed in Table 4 are differences in the amount of charge on toner between a case where the counter electrode is in a grounded state and a case where the counter electrode is in a floating state (a state where there is no electric potential difference between the discharge electrode and the counter electrode). Note that the measurement of toner charging amount is conducted with use of a suction-type compact q/m analyzer (MODEL: 210HS-2A) manufactured by TREK JAPAN K.K.

As will be understood from Table 4, when the counter electrode is in a floating state, the amount of charge on toner remains substantially the same regardless of the presence or absence of ion irradiation. By way of contrast, when the counter electrode is in a grounded state, the amount of charge on toner is increased by 8 to 9 μC/g after the ion irradiation. This is because, when the counter electrode is grounded, an electric field is produced between the discharge electrode and the counter electrode, thus causing the ions generated in the vicinity of the discharge electrode to travel intensively toward the counter electrode, namely toward the transfer belt on which is formed a toner image.

TABLE 4

| Counter electrode status | Toner type | Toner charging amount [μC/g] Before ion irradiation | After ion irradiation | Variation [μC/g] |
|---|---|---|---|---|
| Floating | Black | −6 | −6 | 0 |
| | Color (cyan) | −7 | −8 | I |
| Grounded | Black | −6 | −15 | 9 |
| | Color (cyan) | −7 | −17 | 8 |

(Heating Effect Offered by Heating Section and Effect of Voltage Applied to Counter Electrode)

The ion generating section 20*e* is placed inside a chamber having a volumetric capacity of 1 m$^3$. The counter electrode is arranged in parallel with three pieces of the discharge electrodes 1*e*, with a gap of 5 mm secured therebetween. In this state, an alternating-current voltage is applied to the discharge electrodes 1*e* so as for a counter electrode current of 8 μA to pass through the counter electrode. Listed in Table 5 are differences in applied voltage conditions and ozone generation amount between a case where a voltage of 12 V is applied to an induction electrode 2*e* having resistance of 120Ω by the heating section so as to generate heat of 1.2 W for heating the induction electrode 2*e* and a case where no voltage is applied to the induction electrode 2*e* and thus the induction electrode 2*e* is unheated. Also listed in Table 5 are differences in applied voltage conditions and ozone generation amount between a case where a voltage of +750 V (voltage of a polarity reverse to the polarity of the voltage applied to the discharge electrode 1*e*) is applied to the counter electrode and a case where no voltage is applied to the counter electrode. Note that the ozone generation amount is measured in a manner similar to that described supra.

As will be understood from Table 5, when a comparison is made between the constructions having mica-made dielectric body, in the case of placing the induction electrode 2*e* in a heated state, through the application of a voltage, with the heater power source turned on (ON), as compared with the case of placing the induction electrode 2*e* in an unheated state with the heater power source turned off (OFF), the ozone generation amount can be reduced by approximately 48%. This is because the application of heat to the induction electrode 2*e* causes the ozone generated in the vicinity of the discharge electrode 1*e* to be thermally decomposed. On the other hand, by forming the dielectric body of alumina, it is possible to prevent the dielectric body from absorbing moisture. However, under high-humidity environment, the surface of the dielectric body could be subjected to dew condensation. Although the surface condensation occurring in the dielectric body leads to a decline in discharging capability, by heating the dielectric body by means of the heating section, the surface of the dielectric body can be protected from dew condensation. Moreover, since the induction electrode is designed to serve also as a heating electrode, there is no need to provide a heating electrode independently. This makes it possible to avoid an undesirable increase in equipment size and cost.

Moreover, in the case of applying a voltage of a polarity reverse to the polarity of the voltage applied to the discharge electrode 1*e* to the counter electrode, as compared with the case of applying no voltage to the counter electrode, the frequency can be kept low and also the ozone generation amount can be reduced by approximately 68%. This is because, through the application of a voltage to the counter electrode, an intense electric field is produced between the discharge electrode 1*e* and the counter electrode, whereupon the negative ions generated in the vicinity of the discharge electrode 1*e* are attracted to the counter electrode. As a result, higher ion-use efficiency can be attained, and ions of sufficient quantity can be produced even at a low frequency. This makes it possible to reduce electric power consumption, as well as to prolong the service lifespan of the discharge electrode. In addition to that, the ozone generation amount can be reduced,

TABLE 5

| Dielectric material | Mica | Mica | Alumina |
|---|---|---|---|
| Discharge electrode number | 3 | 3 | 3 |
| Pitch p [mm] | 0.15 | 0.15 | 0.15 |
| Heater power source | OFF | ON (1.2 W) | ON (1.2 W) |
| Counter electrode power supply | OFF | OFF | ON (+750 V) |
| Peak voltage (α) [−kV] | 3 | 3 | 3 |
| Frequency [kHz] | 0.7 | 0.7 | 0.23 |
| Duty (β/γ) [%] | 20 | 20 | 20 |
| Counter electrode current [μA] | 8 | 8 | 8 |
| Actual measurement value of ozone generation amount [ppm] | 0.975 | 0.494 | 0.157 |

(Setting of Counter Electrode Current)

Figure 7:
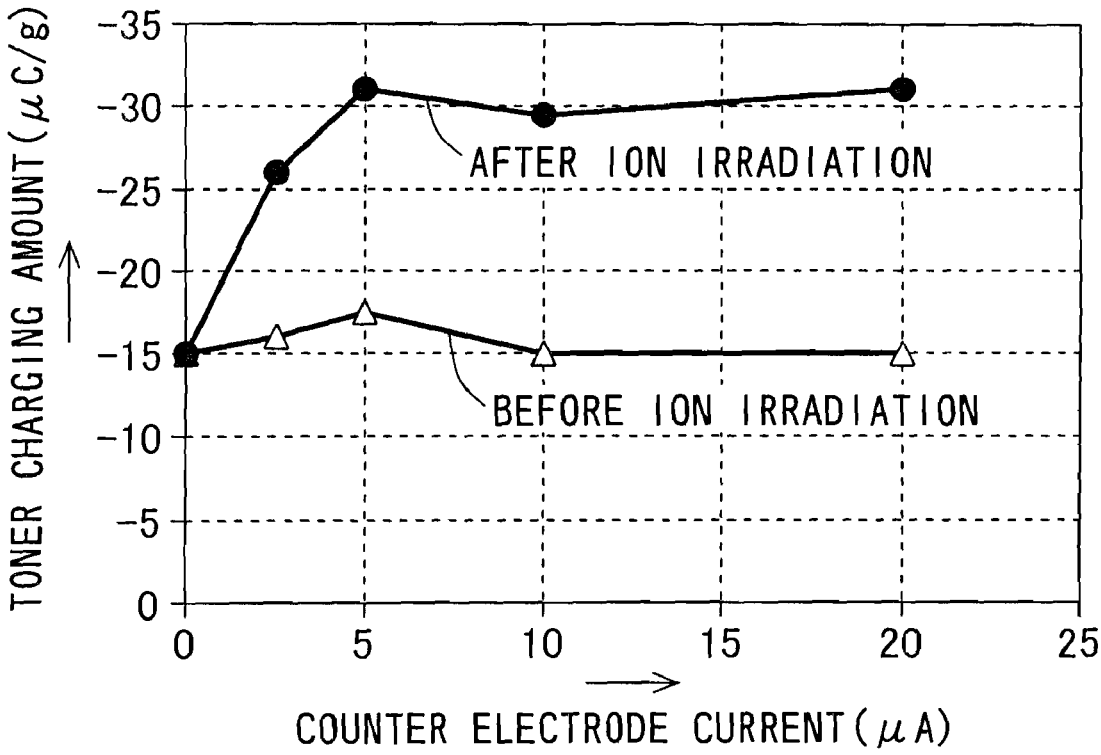
FIG. 7 is a graph showing the relationship between counter electrode current and toner charging amount as observed in the before-recording-transfer charging section.

FIG. 7 is a graph showing the relationship between counter electrode current and toner charging amount as observed in the before-recording-transfer charging section 130. In the graph, the abscissa axis represents counter electrode current (μA) and the ordinate axis represents the amount of charge on toner (μC/g). The before-recording-transfer charging section 130 is applied to, as an image forming apparatus, Color Multifunction Printer MX-4500 manufactured by SHARP CORPORATION. Therein, charging is performed on a toner image borne on the transfer belt, with a stepwise increase of the magnitude of a voltage to be applied to the discharge electrode 1 of the ion generating section provided in the before-recording-transfer charging section 130. The counter electrode current and the toner charging amount obtained at this time are measured. Note that, as the toner image, a solid image (cyan+magenta) having an adherent toner amount of 1 mg/cm$^2$.

As shown in FIG. 7, in an initial state where no voltage is being applied to the discharge electrode 1 of the before-recording-transfer charging section 130, the counter electrode current stands at 0 and the amount of charge on toner stands at approximately −15 μC/g. Subsequently, as an applied voltage to be applied to the discharge electrode 1 is caused to grow larger, the generation amount of negative ion is increased, and the absolute values of the counter electrode current and the amount of charge on toner become larger correspondingly. However, upon the counter electrode current reaching 5 μA or above, the amount of charge on toner becomes saturated at −30 μC/g. As will be understood from this result, where the voltage control section 10 effects control of the discharge voltage applying section 7 in a manner so as to apply a certain voltage to the discharge electrode 1 so as for the counter electrode current to stand at or above 5 μA, the amount of charge on toner becomes stable at −30 μC/g, whereby making the amount of charge on toner uniform. Accordingly, it is preferable that, in response to receipt of a signal from the counter electrode ammeter for measuring the counter electrode current, the voltage control section 10 exercises feedback control over the magnitude of an applied voltage which is applied to the discharge electrode 1 by the discharge voltage applying section 7 in such a manner that the counter electrode current stands at or above 5 μA. This makes it possible for the toner image formed on the transfer belt, namely the to-be-charged body, to be charged with a uniform toner charging amount at all times.

Figure 8:
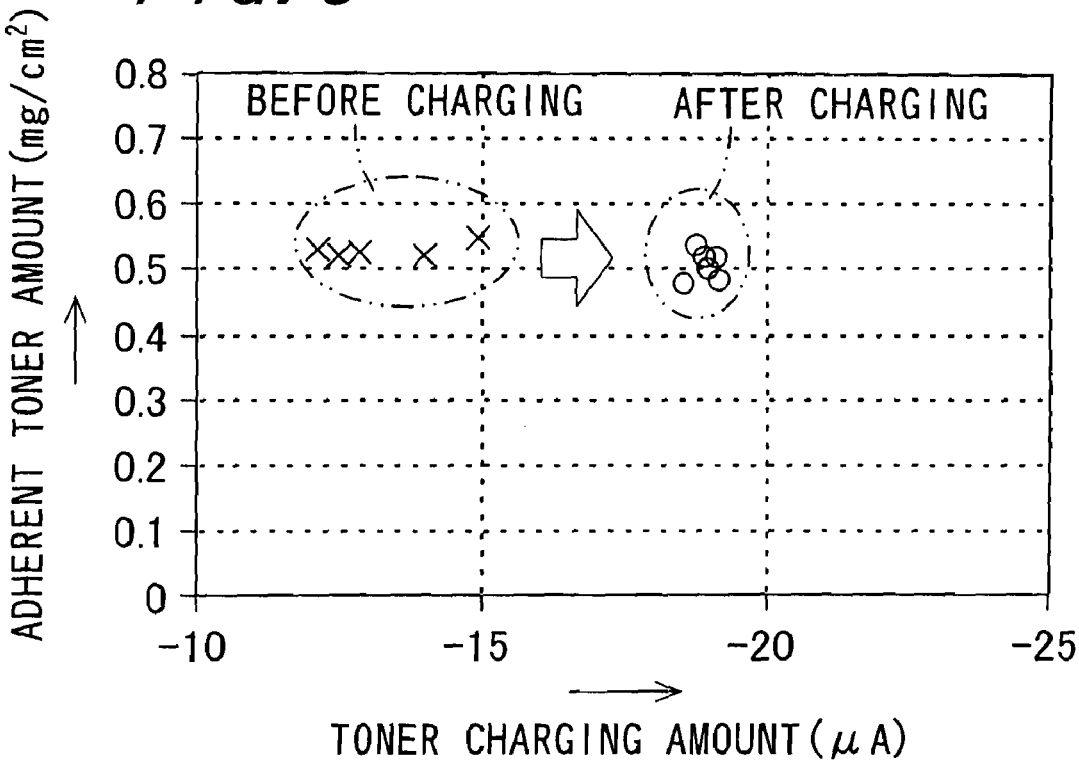
FIG. 8 is a graph showing the relationship between toner charging amount and adherent toner amount as observed in the before-recording-transfer charging section.

FIG. 8 is a graph showing the relationship between toner charging amount and adherent toner amount as observed in the before-recording-transfer charging section 130. In the graph, the abscissa axis represents the amount of charge on toner (μC/g) and the ordinate axis represents the amount of adherent toner (mg/cm$^2$). Under six conditions of varying image patterns and environmental situations (temperatures at which the image forming apparatus is operated, humidity, etc.), the toner image formed on the transfer belt is charged by the before-recording-transfer charging section 130. At this time, the voltage control section 10 exercises feedback control over a voltage which is applied to the discharge electrode 1 by the discharge voltage applying section 7 in such a manner that the counter electrode current stands at 10 μA. As shown in FIG. 8, before the toner image is charged by the before-recording-transfer charging section 130, the amount of charge on toner varies in a range of from −12 μC/g to −15 μC/g; that is, there is a fluctuation range of approximately 3 μC/g. By way of contrast, after the toner image is charged, the amount of charge on toner settles down and varies little in a range of from −18 μC/g to −19 μC/g; that is, the fluctuation range is reduced only to approximately 1 μC/g. As will be understood from this result, where the toner image is charged by the before-recording-transfer charging section 130 while the applied voltage is being feedback-controlled in such a manner that the counter electrode current stands at a fixed value, the amount of charge on toner can be kept uniform.

Figure 9:
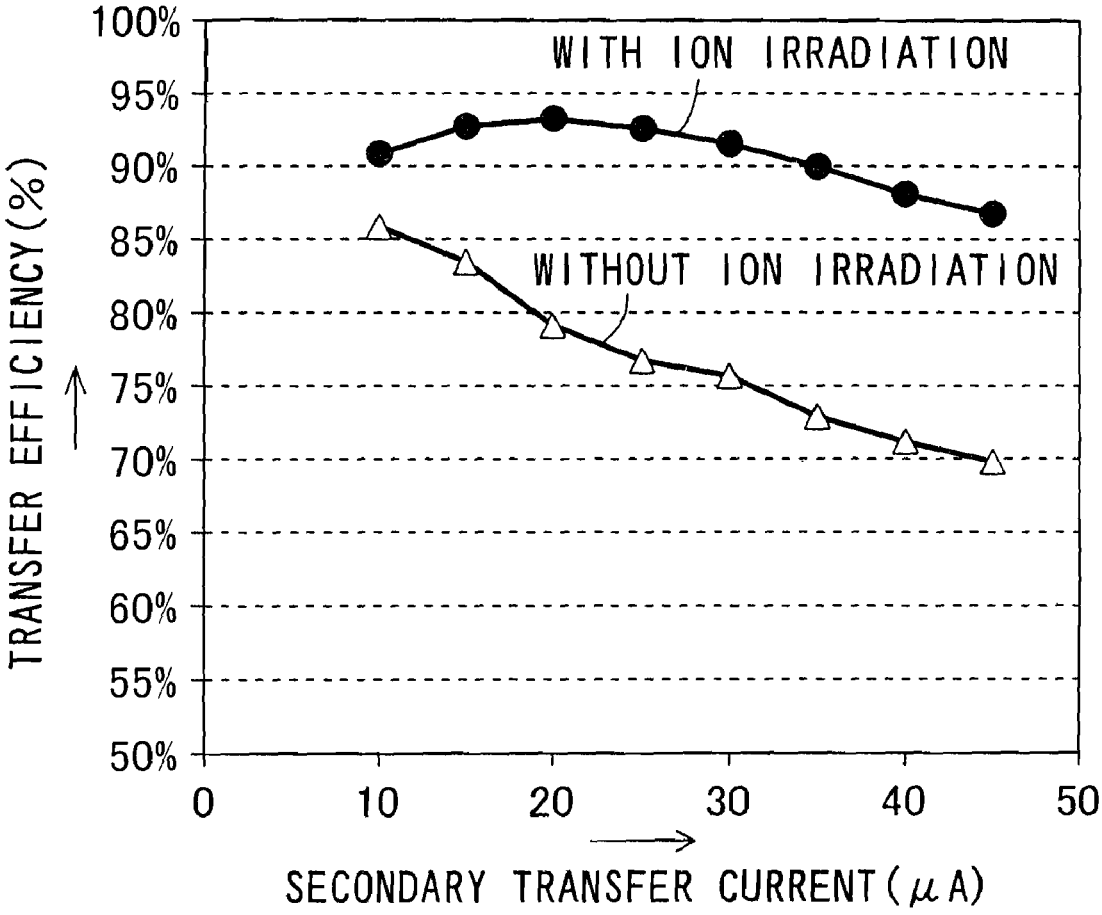
FIG. 9 is a graph showing the relationship between secondary transfer current and transfer efficiency as observed in the before-recording-transfer charging section.
Figure 10:
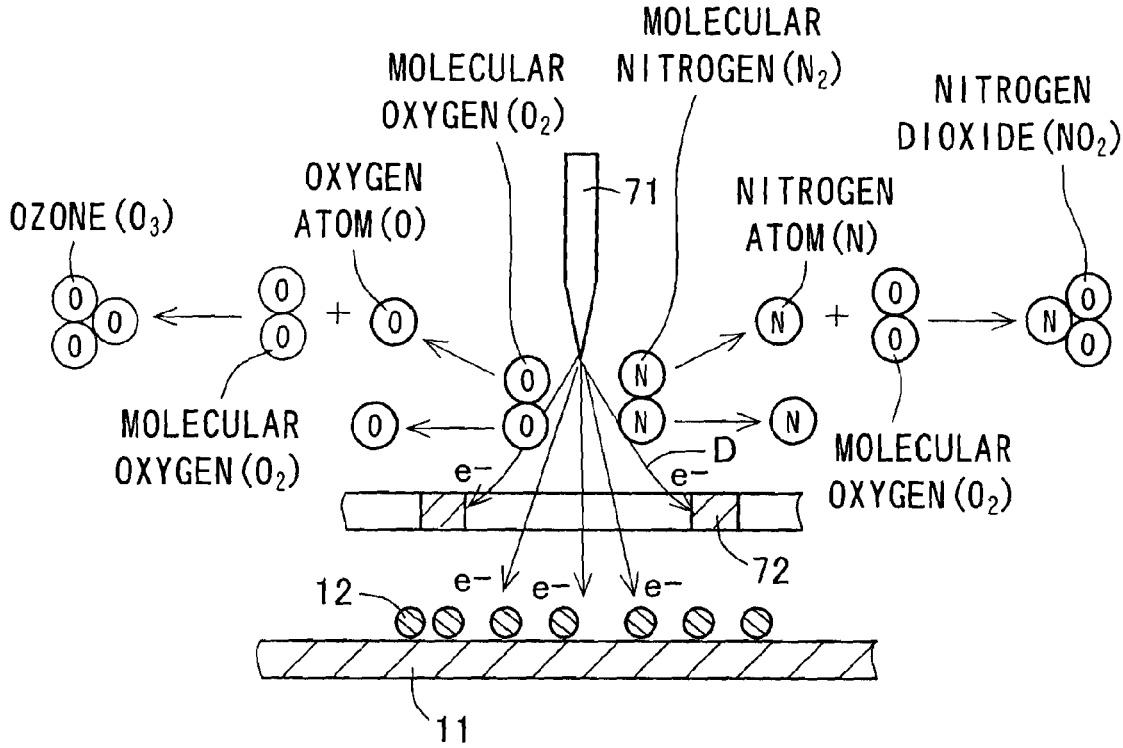
FIG. 10 PRIOR ART
FIG. 10 is a view for explaining a charging mechanism associated with a corona discharge-type charging apparatus as related art.

FIG. 9 is a graph showing the relationship between secondary transfer current and transfer efficiency as observed in the before-recording-transfer charging section 130. In the graph, the abscissa axis represents secondary transfer current (μA) and the ordinate axis represents transfer efficiency (%). A comparison as to transfer efficiency is made between a case where the transfer belt is ion-irradiated by the before-recording-transfer charging section 130 to charge the toner image borne on the transfer belt and a case where the transfer belt is not ion-irradiated. Following the completion of printing on a recording sheet using a solid image with a coverage rate of 100%, the amount of adherent toner on the transfer belt $T_1$ and the amount of adherent toner on the recording sheet $T_2$ are measured. Then, the transfer efficiency η is obtained by calculation on the basis of the following formula: $\eta=(T_2 \div T_1)\times 100$. Moreover, the secondary transfer current refers to an electric current which is caused to flow by applying a transfer bias to the recording transfer roller at the time when the toner image transferred on the transfer belt is transferred onto the recording sheet. As shown in FIG. 9, by allowing the before-recording-transfer charging section 130 to charge the toner image borne on the transfer belt, it is possible to attain enhanced transfer efficiency Moreover, where the toner image borne on the transfer belt is charged by the before-recording-transfer charging section 130, even if the secondary transfer current is caused to vary, the fluctuation range of the transfer efficiency can be decreased, thus widening the latitude (transfer latitude) with respect to the secondary transfer current.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A charging apparatus for charging an image bearing member which bears thereon an electrostatic latent image that is provided in an image forming apparatus, comprising:

an ion generating section which generates ions to charge a toner image formed on the image bearing member; and a counter electrode arranged face to face with the ion generating section, which controls a flow of ions generated by the ion generating section, the ion generating section including a discharge electrode formed on a surface of a dielectric body, an induction electrode formed on a back surface or in an inside of the dielectric body so as to be arranged face to face with the discharge electrode via the dielectric body lying therebetween, and a discharge voltage applying section which applies a voltage between the discharge electrode and the induction electrode, the toner image formed on the image bearing member being charged while the image bearing member is moved between the ion generating section and the counter electrode, and the discharge electrode being so formed as to extend in a direction perpendicular to a direction in which the image bearing member is moved, to have a shape which is conformable to the surface of the image bearing member, and to have an edge with a plurality of sharp-pointed portions so as to take on serrations, a distance g being set as between about 3 mm and 7 mm, and a relationship of $0.06 \leqq p/g \leqq 1$ is satisfied, wherein p (mm) is a pointedness pitch that is an interval between tips of two of the sharp-pointed portions, and g (mm) is a distance from the discharge electrode to the image bearing member, and the ion generating section generating ions by producing a difference of electrical potential between the discharge electrode and the induction electrode by the discharge voltage applying section, and charging the toner image on the image bearing member arranged between the ion generating section and the counter electrode by flowing the generated ions toward the counter electrode.

2. The charging apparatus of claim 1, wherein the induction electrode is so formed as to lie only at a location facing with the sharp-pointed portions.

3. The charging apparatus of claim 1, comprising a heating section which applies heat to the dielectric body.

4. The charging apparatus of claim 1, wherein the counter electrode is grounded.

5. The charging apparatus of claim 1, comprising a counter voltage applying section which applies to the counter electrode, a voltage of a polarity reverse to the polarity of a voltage which is applied to the discharge electrode by the discharge voltage applying section.

6. The charging apparatus of claim 1, wherein the discharge voltage applying section acts to apply a voltage of a magnitude which is greater than or equal to the magnitude of a voltage at which the amount of charge on the image bearing member is brought to a saturating amount.

7. The charging apparatus of claim 1, comprising a voltage control section which controls a magnitude of a voltage which is applied by the discharge voltage applying section on the basis of an amount of electric current flowing through the counter electrode.

8. The charging apparatus of claim 5, comprising a voltage control section which controls a magnitude of a voltage which is applied by the counter voltage applying section on the basis of an amount of electric current flowing through the counter electrode.

9. The charging apparatus of claim 7, wherein the voltage control section exercises feedback control over a magnitude of a voltage which is applied by the discharge voltage applying section so that the amount of electric current passing through the counter electrode is greater than or equal to the amount of electric current passing through the counter electrode at the time when the amount of charge on the image bearing member is brought to a saturating amount.

10. The charging apparatus of claim 8, wherein the voltage control section exercises feedback control over a magnitude of a voltage which is applied by the counter voltage applying section so that the amount of electric current passing through the counter electrode is greater than or equal to the amount of electric current passing through the counter electrode at the time when the amount of charge on the image bearing member is brought to a saturating amount.

11. An image forming apparatus comprising:

an image bearing member which bears thereon an electrostatic latent image; a developing section which forms a toner image by supplying toner to the electrostatic latent image formed on the image bearing member;

a transfer section which transfers the toner image formed on the image bearing member onto a recording medium;

a fixing section which allows the toner image borne on the recording medium to be fixed in place; and a charging section which charges the toner image on the image bearing member, the charging section being constituted by the charging apparatus of claim 1.

12. An image forming apparatus comprising:

an image bearing member which bears thereon an electrostatic latent image;

a developing section which forms a toner image by supplying toner to the electrostatic latent image formed on the image bearing member;

a transfer section which transfers the toner image formed on the image bearing member onto a recording medium;

a fixing section which allows the toner image borne on the recording medium to be fixed in place;

a cleaning section which removes and collects residual toner which remains on the image bearing member after transfer; and a charging section which charges the residual toner which remains on the image bearing member after transfer, the charging section being constituted by the charging apparatus of claim 1.

13. A charging apparatus for charging an intermediate transfer member on which is formed a transferred toner image by transferring a toner image which is formed on an image bearing member provided in an image forming apparatus by supplying toner to an electrostatic latent image formed on the image bearing member, comprising:

an ion generating section which generates ions to charge the toner image transferred on the intermediate transfer member; and a counter electrode arranged face to face with the ion generating section, which controls a flow of ions generated by the ion generating section, the ion generating section including a discharge electrode formed on a surface of a dielectric body, an induction electrode formed on a back surface or in an inside of the dielectric body so as to be arranged face to face with the discharge electrode, via the dielectric body lying therebetween, and a discharge voltage applying section which applies a voltage between the discharge electrode and the induction electrode, the toner image transferred on the intermediate transfer member being charged while the intermediate transfer member is moved between the ion generating section and the counter electrode, and the discharge electrode being so formed as to extend in a direction perpendicular to a direction in which the intermediate transfer member is moved, to have a shape which is conformable to the surface of the intermediate transfer member, and to have an edge with a plurality of sharp-pointed portions so as to take on serrations, a distance g being set as between about 3 mm and 7 mm, and a relationship of $0.06 \leqq p/g \leqq 1$ is satisfied, wherein p (mm) is a pointedness pitch that is an interval between tips of two of the sharp-pointed portions, and g (mm) is a distance from the discharge electrode to the intermediate transfer member, and the ion generating section generating ions by producing a difference of electrical potential between the discharge electrode and the induction electrode by the discharge voltage applying section, and charging the toner image on the intermediate transfer member arranged between the ion generating section and the counter electrode by flowing the generated ions toward the counter electrode.

14. The charging apparatus of claim 13, wherein the induction electrode is so formed as to lie only at a location facing with the sharp-pointed portions.

15. The charging apparatus of claim 13, comprising a heating section which applies heat to the dielectric body.

16. The charging apparatus of claim 13, wherein the counter electrode is grounded.

17. The charging apparatus of claim 13, comprising a counter voltage applying section which applies to the counter electrode, a voltage of a polarity reverse to the polarity of a voltage which is applied to the discharge electrode by the discharge voltage applying section.

18. The charging apparatus of claim 13, wherein the discharge voltage applying section acts to apply a voltage of a magnitude which is greater than or equal to the magnitude of a voltage at which the amount of charge on the intermediate transfer member is brought to a saturating amount.

19. The charging apparatus of claim 13, comprising a voltage control section which controls a magnitude of a voltage which is applied by the discharge voltage applying section on the basis of an amount of electric current flowing through the counter electrode.

20. The charging apparatus of claim 17, comprising a voltage control section which controls a magnitude of a voltage which is applied by the counter voltage applying section on the basis of an amount of electric current flowing through the counter electrode.

21. The charging apparatus of claim 19, wherein the voltage control section exercises feedback control over a magnitude of a voltage which is applied by the discharge voltage applying section so that the amount of electric current passing through the counter electrode is greater than or equal to the amount of electric current passing through the counter electrode at the time when the amount of charge on the intermediate transfer member is brought to a saturating amount.

22. The charging apparatus of claim 20, wherein the voltage control section exercises feedback control over a magnitude of a voltage which is applied by the counter voltage applying section so that the amount of electric current passing through the counter electrode is greater than or equal to the amount of electric current passing through the counter electrode at the time when the amount of charge on the intermediate transfer member is brought to a saturating amount.

23. An image forming apparatus comprising:

an image bearing member which bears thereon an electrostatic latent image;

a developing section which forms a toner image by supplying toner to the electrostatic latent image formed on the image bearing member;

a transfer section which transfers the toner image formed on the image bearing member onto a recording medium via an intermediate transfer member, a fixing section which allows the toner image borne on the recording medium to be fixed in place; and a charging section which charges the toner image borne on the intermediate transfer member, the charging section being constituted by the charging apparatus of claim 13.

* * * * *